US007443263B2

(12) United States Patent
Gruchalla

(10) Patent No.: US 7,443,263 B2
(45) Date of Patent: Oct. 28, 2008

(54) WIDE-BANDWIDTH BALANCED TRANSFORMER

(76) Inventor: Michael E. Gruchalla, 4816 Palo Duro Ave., NE., Albuquerque, NM (US) 87110

( * ) Notice: Subject to any disclaimer, the term of this patent is extended or adjusted under 35 U.S.C. 154(b) by 182 days.

(21) Appl. No.: 11/190,318

(22) Filed: Sep. 30, 2005

(65) Prior Publication Data

US 2007/0075802 A1 Apr. 5, 2007

(51) Int. Cl.
*H01P 5/10* (2006.01)

(52) U.S. Cl. ..... 333/26

(58) Field of Classification Search ..... 333/25, 333/26, 27

See application file for complete search history.

(56) References Cited

U.S. PATENT DOCUMENTS

| | | | |
|---|---|---|---|
| 2,231,152 | A | 2/1941 | Buschbeck |
| 3,913,037 | A | 10/1975 | Himono et al. |
| 2007/0075802 | A1 | 4/2007 | Gruchalla |

OTHER PUBLICATIONS

Sevick, Jerry, "Design and Realization of Broadband Transmission Line Matching Transformers", Emerging Practices In Technology., IEEE Standard Press, 1993, pp. 1-10.

Baum, Carl E., "Characteristics of the Mobius Strip Loop", Sensor and Simulation Notes VII, 1964, pp. 1-14.

*Primary Examiner*—Stephen E Jones
(74) *Attorney, Agent, or Firm*—David M Ostfeld

(57) ABSTRACT

The present invention comprises novel means and apparatus which provide both impedance matching of arbitrary impedances and transformation between single-ended, floating, and balanced circuits over very wide operating bandwidths with very low excess loss and very low phase and magnitude ripple in the pass band. The present invention can provide high-performance matching, for example from a 50-ohm single-ended system to a 100-ohm balanced system over a bandwidth of 10 kHz to 10 GHz with an excess loss of less than nominally 1 dB and a bandpass magnitude ripple of less than ±0.5 dB. The present invention also provides precision low-loss power division over very wide-bandwidth. The novel means, according to the present invention, can utilize commonly available materials and can be optimized for specific applications to tailor performance to specific needs and to simplify assembly and reduce cost.

17 Claims, 17 Drawing Sheets

WIDE-BANDWIDTH BALANCED TRANSFORMER

FIELD OF THE INVENTION

The present invention relates to a wide-bandwidth transformer device.

BACKGROUND OF THE INVENTION

A type of gap in transmission line in the prior art is termed a "Mobius gap" due to its similarity to the connection in a strip of material that is applied to form a Mobius loop. Specifically to form a Mobius loop, as is known in the prior art, a single twist in made in the strip of material having a first side and a second side, a long slender strip of paper for example, and the two ends of the strip of material are butted together to form a loop. When the two ends of the strip are butted together in this fashion, the first side of the strip at the first end aligns with the second side of the strip at the second end such that if a pencil line is drawn across the butted connection, it would mark the first side of the strip on one side of the connection and the second side of the strip on the other side of the connection. If the pencil line is then continued along the strip without lifting the pencil from the strip, it is found that the pencil marks a continuous line on both sides of the strip forming the loop indicating that the connection of the two ends of the strip in the manner noted has resulted in the loop thus formed having only a single continuous surface. Specifically, the strip forming this loop no longer has a first side and a second side, but only a single side. This is the Mobius loop configuration, and the connection used to form the Mobius loop in the original long slender strip of material is termed a "Mobius connection."

A Mobius-type connection may also be applied to a transmission-line structure, such as a length of coaxial cable for example, as is also known in the art. Consider a conventional coaxial transmission-line section having an outer conductor and an inner conductor and having a first end and a second end. The two ends of this coaxial transmission-line section are brought toward each other as would be done in a simple butt connection to form a loop. However, rather than a simple butt connection, the inner conductor at the first end is connected to the outer conductor at the second end, and the inner conductor at the second end is connected to the outer conductor at the first end. If a continuous electrical path is now traced, for example starting at the inner conductor at the first end and moving along the inner conductor from the first end, it is found that there is only a single conductor forming the loop. Specifically, starting at the inner conductor at the first end of the coaxial transmission-line section, the path travels continuously along the inner conductor of the line section until it reaches the second end of the line section at which point the path communicates unbroken to the outer conductor of the line section at the first end of the line section and proceeds along the outer conductor until it again reaches the second end where it communicates to the inner conductor of the first end of the line section, which is the starting point of the circuit path. Accordingly, as in the Mobius loop, where the two surfaces of a strip of material become a single surface with the Mobius connection, the two conductors of the coaxial transmission-line section become a single continuous conductor with the application of the Mobius connection. The connection of the two ends of the coaxial transmission-line section as described hereinabove is therefore also termed a Mobius connection when applied to the coaxial transmission-line section. However, since the coaxial cable inner conductors and outer conductors cannot be as gracefully connected in a Mobius connection as can be the ends of the strip in a Mobius loop applied to a strip of material, a small gap occurs at the point of the Mobius connection in the coaxial transmission-line section. This gap at the point of the Mobius connection of the coaxial transmission line section is termed a "Mobius gap", in the prior art.

The Mobius gap is common in the prior art to provide a 1:1 ratio inverting transformer in a coaxial transmission-line section. A typical example of such a 1:1 inverting transformer is the Model 5100 Boradband Pulse Inverter by Picosecond Pulse Labs. Such a 1:1 inverting transformer is formed in a coaxial transmission line section comprising an outer conductor and an inner conductor further comprising a first end and a second end. At both the first end and second end of the coaxial transmission-line section the outer conductor is connected to ground, and the inner conductor is connected at the first end to a source and the inner conductor at the second end is connected to a load. In this configuration, the signal introduced at the source is passed substantially undisturbed to the load. To form a 1:1 inverting transformer, the coaxial transmission-line section is cut at a point between the first and second ends, and rejoined with a Mobius gap as described hereinabove. With the Mobius gap provided in the coaxial transmission-line section, the signal introduced at the first end of the coaxial transmission-line section is presented to the load at the second end with the same magnitude but inverted in sign. Therefore, the signal from the source is inverted when it is presented at the load.

At low frequencies, the coaxial transmission-line section comprising a Mobius gap appears as a short circuit to the source since the inner conductor at the first end of the coaxial transmission-line section comprising a Mobius gap eventually communicates to ground at the second end of the coaxial transmission-line section. For high-frequency signals, short pulses for example, where the coaxial transmission-line section is long with respect to the characteristic wavelength of the signal, the coaxial transmission-line section comprising a Mobius gap presents as a high-performance 1:1 inverting transformer. For example, if a square pulse is applied to the first end of a transmission-line section comprising a Mobius gap, and where the pulse width is shorter than the transit time of the coaxial transmission-line section, the pulse will travel along the coaxial transmission-line section, across the Mobius gap, continue along the coaxial transmission-line section being finally delivered to a load connected to the second end of the coaxial transmission-line section, and where the pulse when delivered to the load is inverted with respect to the polarity launched at the first end of the coaxial transmission-line section. Because the coaxial transmission-line section is long with respect to the pulse width, the connection to ground at the second end of the coaxial transmission-line section does not affect the source since there is insufficient time during the pulse for signals to travel the full length of the coaxial transmission-line section.

As noted hereinabove, the Picosecond Pulse Labs Model 5100 Broadband Pulse Inverting Transformer provides means to invert an RF signal and provides a 1:1 impedance transformation. A serious disadvantage of the Broadband Pulse Inverting Transformer taught by Picosecond Pulse Labs is that it is limited to a 1:1 impedance transformation ratio. Another serious disadvantage of the Broadband Pulse Inverting Transformer taught by Picosecond Pulse Labs is that it provides only an unbalanced, single-ended signal.

The earliest reference to the Mobius connection applied to a transmission line, and specifically to a coaxial transmission line, that could be located is in the paper "Characteristics of the Mobius Strip Loop," Sensor and Simulation Note 7, 1964, by Carl E. Baum ("the noted paper"). A copy of the noted paper is attached for reference.

The sensor configuration described in the noted paper was termed "Mobius Strip Loop" because of the Mobius connection made at the gap were the outer and inner conductors of the transmission line comprising the sensor are cross coupled as shown in FIG. 4 of the noted paper.

Whereas the gap device of the Mobius Strip Loop sensor creates a Mobius-type structure in a coaxial transmission line similar to a Mobius connection made in a strip of flexible material, that gap device has become known as a "Mobius Gap." When the term "Mobius Gap" is encountered by one skilled in the art of wide-bandwidth electromagnetic sensors, such as the Mobius Gap Loop for example, it is widely understood that such reference describes the gap device as shown in FIG. 4 of the noted paper.

FIG. 4 of the noted paper shows the Mobius Gap device as described by Gruchalla in Patent Application US 2007/0075802 A1 published Apr. 5, 2007.

Wide-bandwidth transformer devices are very common in the prior art for such applications as providing impedance matching between the source and load in radio-frequency ("RF") applications. Balanced transformer devices ("balun") are also common in applications where a balanced signal is required from a single-ended source and where a balanced signal is to be delivered to a single-ended load. In the prior art, it is problematic to provide both impedance transformation between two arbitrary impedances and single-ended-to-balanced transformation. Specifically, low-loss transformation of impedances is typically limited to ratios related by the squares of whole numbers. The following examples are easily provided with devices of the prior art: a 1:1 transformation, the square of 1, and a 4:1 transformation, the square of 2. However, a transformation such as 50 ohms to 100 ohms, an impedance ratio of the square-root of 2, is not typically provided in low-loss devices of the prior art. In prior-art devices providing such a transformation, bandwidth is limited to only several octaves and insertion loss is comparatively high. The devices of prior art cannot satisfy the requirements to provide transformation between single-ended and balanced circuits in a device that also provides impedance matching between two arbitrary impedances over a very wide-bandwidth and with very low loss.

Transformer devices providing 1:1 impedance matching between single-ended and balanced circuits are very common in the prior art. Such a single-ended to balanced 1:1 impedance-transformation device is described in U.S. Pat. No. 3,913,037, entitled "Broad Band Balanced Modulator," to Yusaku Himono, et al. Yusaku teaches a configuration comprising as an integral element a transformer structure providing single-ended to balanced transformation and 1:1 impedance transformation, Item 8 and Item 2 according to Yusaku. According to Yusaku, a parallel-wire transmission line is wound about a toroidal magnetic core assembly thereby providing transition from a single-ended to a balanced configuration. A serious disadvantage of the prior art taught by Yusaku is that only a 1:1 impedance transformation is provided. Another serious disadvantage of the prior art taught by Yusaku is that its construction is generally limited to parallel-wire transmission-line sections. Such transmission line constructions are not totally bounded-wave electromagnetic configurations and therefore are severely limited in maximum operating frequency where the length of such line structure is comparatively long or where such line section is in the vicinity of other circuit elements or physical features of the system in which incorporated.

Wide-bandwidth impedance transformation devices where the transformation ratio is the square of whole numbers are very common in the prior art. Such transformation devices are classically termed in the prior art "constant-delay" transformers. A balanced transformation device for providing a 4:1 single-ended to balanced impedance transformation, an impedance transformation of 2 squared, is described in U.S. Pat. No. 2,231,152, entitled "Arrangement for Resistance Transformation," to Werner Buschbeck. Buschbeck teaches a configuration of two coaxial transmission-line sections of equal impedance and equal electrical length connected in cross-coupled parallel at one end and in series at the other end where series and parallel connection refer here specifically to the effective arrangement of the line impedances and not to the line lengths. At the cross-coupled-connected end of the configuration taught by Buschbeck, the shields and center conductors of the two coaxial transmission-line sections are cross connected wherein the center conductor of each coaxial transmission-line section is connected to the shield conductor of the opposite coaxial transmission-line section. This arrangement effectively ties the impedances of the two coaxial transmission-line sections in parallel. Therefore, the impedance presented at this parallel connection of the two coaxial transmission-line sections is one half the impedance of the coaxial transmission-line sections. At the series-connected end of the configuration taught by Buschbeck, the shield conductors of the two coaxial transmission-line sections are series connected wherein the shield conductor of each coaxial transmission-line section is connected to the shield conductor of the opposite coaxial transmission-line section and the signal is taken from the two coaxial-line center conductors. This arrangement effectively ties the impedances of the two coaxial transmission-line sections in series. Therefore, the impedance presented at this series connection of the two coaxial transmission-line sections is twice the impedance of each coaxial transmission-line section. Accordingly, the impedance transformation between the parallel-connected feature and the series-connected feature in the prior art taught by Buschbeck is 4:1. Buschbeck additionally teaches ¼-wavelength means to control electromagnetic radiation from the excited shield conductors at the parallel-connected feature. A serious disadvantage of the prior art taught by Buschbeck is that only a 4:1 impedance transformation is provided, for example, 50 ohms to 200 ohms or 100 ohms to 25 ohms. Another serious disadvantage of the prior art taught by Buschbeck is that it must be applied where the various feature lengths are ¼ wavelength. Accordingly, the prior art taught by Buschbeck is limited to effectively single-frequency or very narrow-band operation.

A classic 4:1 impedance matching single-ended-to-balanced transformation device comprising coaxial transmission-line sections is the "Guanella Balun." The Guanella balun is described in the article entitled "Novel Matching Systems for High Frequencies," *Brown-Boveri Review*, Vol. 31, Sep. 1944, pp. 327-329, by Geanelli Guanella. Guanella teaches a configuration wherein the electrical arrangement is identical to the prior art taught by Buschbeck but with a magnetic core means introduced to improve the operating bandwidth. Whereas the device taught by Guanella is substantially electrically equivalent to that taught by Buschbeck, the device taught by Guanella is also limited to impedance transformation values that are the squares of whole numbers, 1:1 and 4:1 for example. This is a serious deficiency where matching of impedances having arbitrary impedance ratios is required.

Wide-bandwidth transformation devices providing transformation ratios other than the squares of whole numbers are also common in the prior art. Such devices are described in the article by Jerry Sevick entitled "Design and Realization of Broadband Transmission Line Matching Transformers," *Emerging Practices in Technology*, EEE Standards Press, 1993. Sevick teaches an equal-delay transformer comprising series/parallel connections of several equal-length transmission-line sections of specific characteristic impedance to effect impedance transformation ratios other than the square of a whole number. As noted previously, these are termed constant-delay transformers in the art. For example, one configuration taught by Sevick comprises three 33.33-ohm transmission-line sections combined in series and parallel combinations in combination with magnetic core elements to provide a 2.25:1 transformation and wide-bandwidth performance. A serious deficiency of the prior art taught by Sevick is that the physical geometry does not present a balanced coupling to free space and therefore cannot provide high-performance balanced operation because of the single-ended parasitic free-space coupling.

In the same work referenced hereinabove entitled "Design and Realization of Broadband Transmission Line Matching Transformers," Sevick also teaches a configuration providing improved balance with a 2.25:1 impedance-transformation ratio. This configuration taught by Sevick comprises a quadrifilar-wound transformer providing a 2.25:1 impedance transformation followed by a bifilar-wound Guanella 1:4 balun. The resulting configuration provides a 1:2.25 impedance transformation and balanced operation at the high-impedance port. Matching between, for example, a 50-ohm single-ended circuit and a 112.5-ohm balanced circuit is thereby provided. A serious deficiency in the prior art taught by Sevick is that the quadrifilar and bifilar winding configurations are not well defined in impedance and are not fully bounded-wave electromagnetic structures. Therefore, the configuration taught by Sevick is severely limited in operating frequency where the line lengths are comparatively long or where such line sections are in the vicinity of other circuit elements or physical features of the system in which incorporated.

It is an object of the present invention to effect both impedance transformation and transformation between single-ended and balanced circuits of arbitrary impedances while providing low-loss and very wide-bandwidth.

It is an object of the present invention to provide very wide-bandwidth matching between two arbitrary impedances.

Another object of the present invention is to provide highly-balanced performance over very wide bandwidth.

Another object of the present invention is to provide both arbitrary impedance matching and highly balanced single-ended-to-balanced operation over very wide-bandwidth.

Another object of the present invention is to provide, with low loss, wide-bandwidth, multiple identical output signals from a single source.

Another object of the present invention is to provide precision, low-loss, wide-bandwidth power division.

Another object of the present invention is to combine, with low loss and wide-bandwidth, multiple input signals to a single output signal.

Another object of the present invention is to simplify construction of RF impedance transformation devices by application of commonly available materials in novel constructions.

Another object of the present invention is to provide means to utilize various transmission-line structures to effect both transformation between two arbitrary impedances and transformation between two single-ended circuits.

Another object of the present invention is to provide means to utilize various transmission-line structures to effect both transformation between two arbitrary impedances and transformation between single-ended and balanced circuits.

Still another object of the present invention is to provide means to utilize various transmission-line structures to effect both transformation between two arbitrary impedances and transformation between single-ended and floating circuits.

Additional objects and advantages of the present invention in part will be set forth from the description that follows and in part from the description or learned by practice of the present invention. The objects and advantages of the present invention may be realized and obtained by the methods and apparatus particularly pointed out in the appended claims.

It is a further object of the Wide-Bandwidth Balanced Transformer of the present invention to overcome the deficiencies of the devices of the prior art such as taught by Yusaku.

It is a further object of the Wide-Bandwidth Balanced Transformer invention to overcome the deficiencies of the devices of the prior art such as taught by Buschbeck.

It is a further object of the Wide-Bandwidth Balanced Transformer invention to overcome the deficiencies of the devices of the prior art such as taught by Guanella.

It is a further object of the Wide-Bandwidth Balanced Transformer invention to overcome the deficiencies of the devices of the prior art such as taught by Sevick.

SUMMARY OF THE INVENTION

The Wide-Bandwidth Balanced Transformer according to the present invention achieves the objects set forth by novel means comprising a plurality of transmission-line segments and a Mobius gap provided in one or more such transmission-line segments.

The present invention relates to a device providing impedance transformation and transformation between single-ended and balanced circuits over a bandwidth of as much as 20 octaves while also providing low insertion loss and very low phase and amplitude ripple in the pass band. The present invention effects both impedance transformation and transformation between single-ended and balanced circuits of arbitrary impedances while providing low loss and very wide-bandwidth by means of novel arrangements of coaxial transmission-line structure or sections and magnetic elements.

Incorporating coaxial transmission-line sections provides high-performance transformation between single-ended and balanced circuits and impedance matching between two arbitrary impedances over a very wide bandwidth. Accordingly, the invention has ability to apply a wide range of transmission-line structures to provide impedance matching between single-ended and balanced circuits of arbitrary impedance over very wide-bandwidth with very low loss.

Whereas the coaxial transmission-line structure provides a very well-defined bounded-wave structure for communication of high-frequency signals, operation to very high frequencies is provided according to the present invention comprising coaxial-line structures. Further, whereas the conductors of conventional transmission lines, for example, the two conductors of coaxial and parallel-conductor transmission lines, are each continuous conductors, these conductors are simultaneously applied as conventional transformer windings to also provide low-loss, low-frequency operation in the present invention. Therefore, the present invention significantly improves the bandwidth and loss over the prior art of impedance transformation between two arbitrary impedances and in the transformation between single-ended and balanced circuits.

The present invention achieves the objects set forth above by novel means and apparatus whereby transformation between two arbitrary impedances is provided and where transformation between single-ended and balanced circuits is provided. Specifically, to, achieve the objects and in accordance with the purposes of the present invention as broadly described herein, the present invention provides a wide-bandwidth balanced transformer device comprising: a transformation mechanism or means providing wide-bandwidth transformation between two arbitrary impedances; a single-ended-to-balanced mechanism or means providing transformation from a single-ended circuit to a balanced circuit; and transforming mechanism or means providing phase transformation allowing optimization of physical topology to improve bounded-wave operation resulting in very wide-bandwidth operation which together, according to the present invention, provide the mechanism or means of impedance matching between two arbitrary impedances with transformation between single-ended and balanced circuits over very wide bandwidth and with very low loss.

BRIEF DESCRIPTION OF THE DRAWINGS

For a further understanding of the nature and objects of the present invention, reference should be had to the following drawings wherein like parts are given like reference numerals and wherein.

DESCRIPTION OF THE PREFERRED EMBODIMENT

Figure 1:
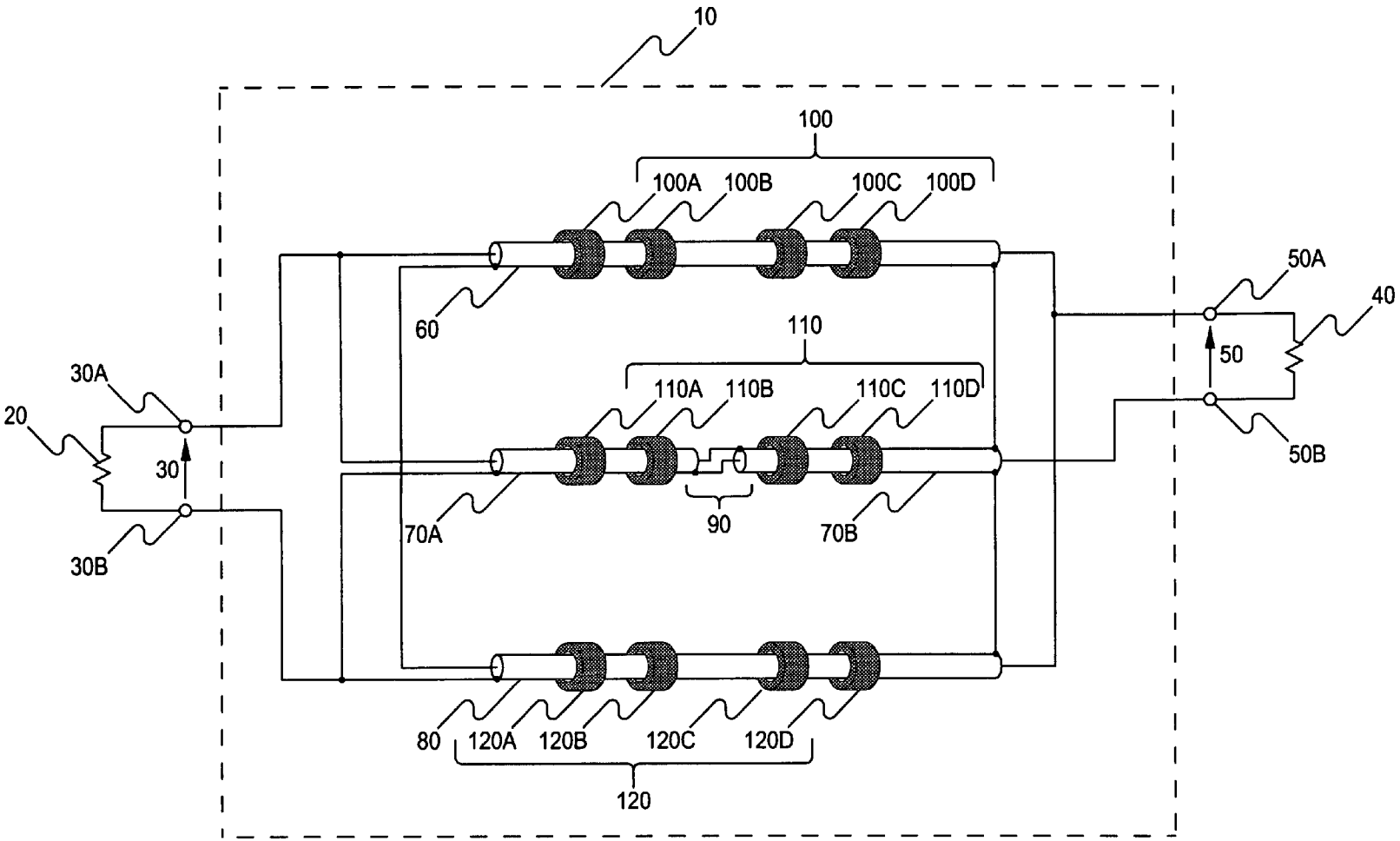
FIG. 1 illustrates a connection of a plurality of transmission-line mechanisms and a plurality of magnetic means providing impedance transformation between two impedances, where either or both of the two impedances may be single-ended with respect to ground, floating with respect to ground, or balanced to ground, in a physical topology providing very wide-bandwidth, low-loss operation.

The embodiment of the present invention illustrated in FIG. 1 comprises a novel connection of a plurality of transmission-line sections or means and a plurality of magnetic mechanisms or means providing impedance transformation between two arbitrary impedances, where either or both of the two impedances may be single-ended with respect to ground, floating with respect to ground, or balanced to ground, in a physical topology providing very wide-bandwidth, low-loss operation. Such impedance transformation in combination with means or mechanism to match between single-ended, floating, and balanced circuits with very wide-bandwidth, low loss operation represent significant and novel improvements provided by the present invention over transformation means of the prior art.

With reference to FIG. 1, transformation means or device 10 provides impedance matching between an impedance 20 at port 30 and impedance 40 at port 50. Port 30 comprises terminals 30A, 30B between which impedance 20 is located. Port 50 comprises terminals 50A, 50B between which impedance 40 is located. The embodiment of the present invention illustrated in FIG. 1 comprises an equal-delay transformer comprising transmission-line sections or means 60, 70A, 70B, 80. Transmission-line means 60, 70A, 70B, 80 are shown in FIG. 1 as coaxial transmission-line sections for illustrative purposes only, but any transmission-line section may be applied. For example, a twisted-pair transmission line section or means or a parallel-plate transmission line section or means may be utilized for one or more of the transmission-line sections or means. In normal practice of the present invention, transmission-line sections or means 60, 70A, 70B, 80 would be all of the same impedance, but may be of all different impedances or of a combination of similar and differing impedances to achieve specific operation required in applications of the present invention.

In order to achieve very high-frequency performance in a transformation mechanism comprising transmission-line section or means, either coaxial or other line constructions, the conductors of the transmission-line sections or means must be very carefully physically managed to maintain very accurate impedance and electrical-length characteristics throughout the structure. Maintaining such accurate characteristics is contraindicated where the line conductors, for example, the shields and center conductors of a coaxial line section or means, must be interconnected in uncommon configurations to achieve specific operation, impedance transformation for example. The present invention achieves very accurate control of impedance and electrical length by means of novel connections of the several transmission-line sections or means.

In impedance transformation devices of the prior art comprising transmission lines, numerous cross couplings of the several shields and center conductors are required to achieve proper transformation. Such prior-art transformation devices are well described in the prior art and therefore are not repeated herein. The requirement for multiple cross couplings between shields and center conductors as is common in devices of the prior art severely compromises the geometry of the RF structure which compromises RF performance by introducing anomalous operation, excess loss, and reduction of bandwidth. The present invention overcomes these deficiencies of the prior art by means of novel transmission-line constructions. Specifically with reference to FIG. 1, transmission-line sections or means 70A and 70B are connected together in a configuration termed a Mobius-Gap portion or means 90. The Mobius-Gap portion or means 90 provides a very high-performance means of interchanging the shield and center conductors of a transmission-line means thereby achieving signal inversion with very low loss and very wide bandwidth. Mobius-Gap portion or means 90 applied according to the present invention allows the physical geometry to be configured to optimize the RF performance to achieve very wide-bandwidth operation. For example, it can provide very accurate control of the symmetry of parasitic coupling and very precise maintenance of bounded-wave structures. Specifically, Mobius-Gap portion or means 90, as illustrated in FIG. 1, provides the shields of transmission-line means 60, 70B, 80 at port 50 to be all connected directly together while at port 30 provides the shields of transmission-line means 70A, 80 to be connected directly together and the center conductors of transmission-line means 70A, 60 to be connected directly together. Accordingly, the Mobius-Gap portion or means 90 provides both improved control of the geometry in the transformation means and simplified construction of devices whereby similar features of transmission-line sections or means, shields or center conductors for example, are connected directly together. This reduces or eliminates the need for cross coupling of shields and center conductors as is required in prior art devices. Also, the use of one or more Mobius-Gap portions or means may be applied to optimize interconnection of the several transmission-line sections or means for specific applications of the present invention, for example where printed-circuit means are utilized to provide interconnections to the plurality of transmission-line sections or means. Useful operation is provided to frequencies in excess of 10 GHz. Application of one or more Mobius-Gap portions or means improving operation to very high frequencies with low loss is a novel feature of the present invention over the prior art. Operation to such high-frequency is provided in addition to operation to very low frequencies, for example to below 10 kHz, providing a frequency range of operation over as much as 20 octaves. Operations over such wide-bandwidth and to such high frequency with low loss are also novel features of the present invention over the prior art.

With reference to FIG. 1, the operation of present invention is fully bi-directional providing signals to communicate both from port 30 to port 50 and from port 50 to port 30. More specifically, a source, having a source impedance 20, may be applied at port 30 delivering power to a load 40 at port 50, and where the source impedance 20 is matched to load impedance 40 by transformation mechanism or means 10 to provide low-loss operation. Similarly, a source, having a source impedance 40, may be applied at port 50 delivering power to a load 20 at port 30, and where the source impedance 40 is matched to load impedance 20 by transformation mechanism or means 10 to provide low-loss operation. Further, signals may travel both from port 30 to port 50 and from port 50 to port 30 simultaneously in applications according to the present invention. An example of the use of bi-directional signal flow is where it is desired to measure the power reflected back to the source from the load.

The embodiment of the present invention illustrated in FIG. 1 provides a nominal 1:2 impedance transformation. For example, if impedance 20 were 50 ohms, impedance 40 were 100 ohms, and the impedance of each transmission-line sections 60, 70A, 70B, 80 were made 70.7 ohms, the present invention would provide wide-bandwidth, low-loss matching of these two impedances with a VSWR of nominally 1.06:1. To explain in greater detail, the impedance presented at port 30 is equal to the impedance of line section or means 70A in parallel with the impedances of line sections or means 60, 80 in series. Whereas the impedances of all three sections or line means 60, 70A, 80 are 70.7 ohms, the impedance presented at port 30 is 70.7 ohms in parallel with the combination of 70.7 ohms in series with 70.7 ohms. Accordingly, the impedance presented at port 30 is 47.1 ohms. This results in a VSWR of nominally 1.06:1 at port 30, which is a very acceptable performance. The impedance presented at port 50 is the 70.7 ohm impedance of line section or means 70B in series with the combined impedance of line section or means 60, 80 in parallel, or 70.7 ohms in series with 70.7 ohms in parallel with 70.7 ohms, which results in an impedance of 106 ohms presented at port 50. The VSWR at port 50 is then also 1.06:1. Accordingly, the embodiment of the present invention illustrated in FIG. 1 provides an impedance transformation to match an impedance 20 at port 30 to an impedance 40 at port 50. For example, a 50-ohm impedance at port 30 may be matched to a 100-ohm impedance at port 50 with a VSWR of nominally 1.06:1.

The 70.7 ohm impedance of the transmission-line sections or means 60, 70A, 70B, 80 described above is intended as illustrative only, and any impedance may be applied. For example, matching between a 100-ohm circuit at port 30 and a 200-ohm circuit at port 50 is provided wherein transmission-line sections or means 60, 70A, 70B, 80 are all made 141.4 ohms. Similarly a 25-ohm circuit at port 30 may be matched to a 50-ohm circuit at port 50 wherein the transmission-line sections or means 60, 70A, 70B, 80 are all made 35.4 ohms. Further, embodiments according to the present invention may comprise greater or fewer line sections or means to achieve specific operation required in applications of the present invention. For example, a greater number of line sections or means may be applied according to the present invention to achieve more accurate impedance matching in order to achieve lower VSWR.

Figure 2:
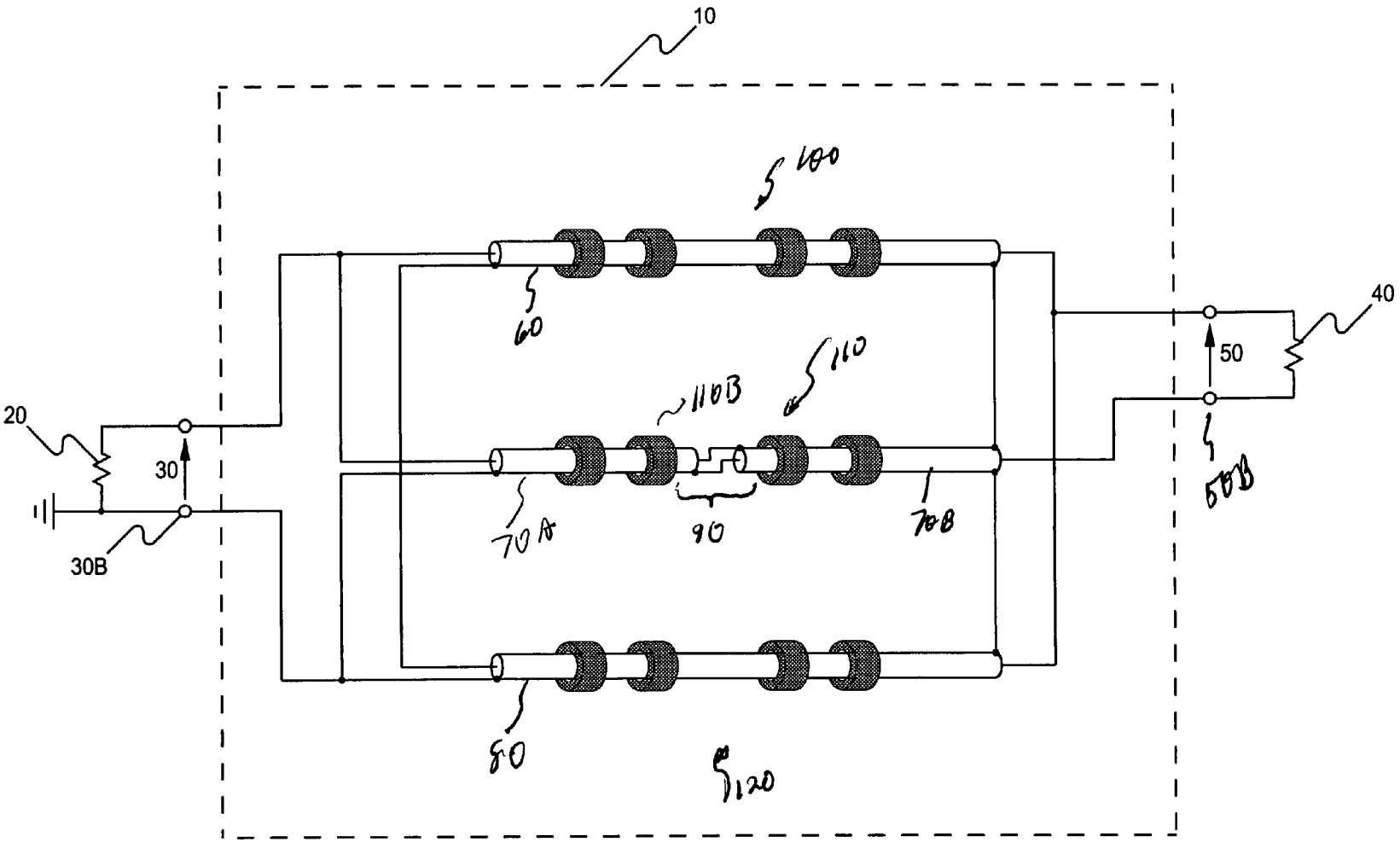
FIG. 2 illustrates an application providing impedance matching between impedance 20 that is single-ended to ground where terminal 30B is connected to ground and impedance 40 that is floating with respect to ground.

With reference to FIG. 1, the terminals 30A, 30B of port 30 are both floating with respect to ground, and the terminals 50A, 50B of port 50 are also both floating with respect to ground. Since both ports 30 and 50 are totally floating, the present invention may be applied with totally floating impedances 20, 40 or in circuits where either terminal or either port is grounded. Accordingly, the embodiment of the present invention, as illustrated in FIG. 1, may be applied to provide matching where the two circuits are totally floating with respect to ground, where the two circuits are both single-ended to ground, or where one circuit is single-ended to ground and the other is floating with respect to ground. For example, FIG. 2 illustrates an application providing impedance matching between impedance 20 that is single-ended to ground where terminal 30B is connected to ground and impedance 40 that is floating with respect to ground.

Figure 3:
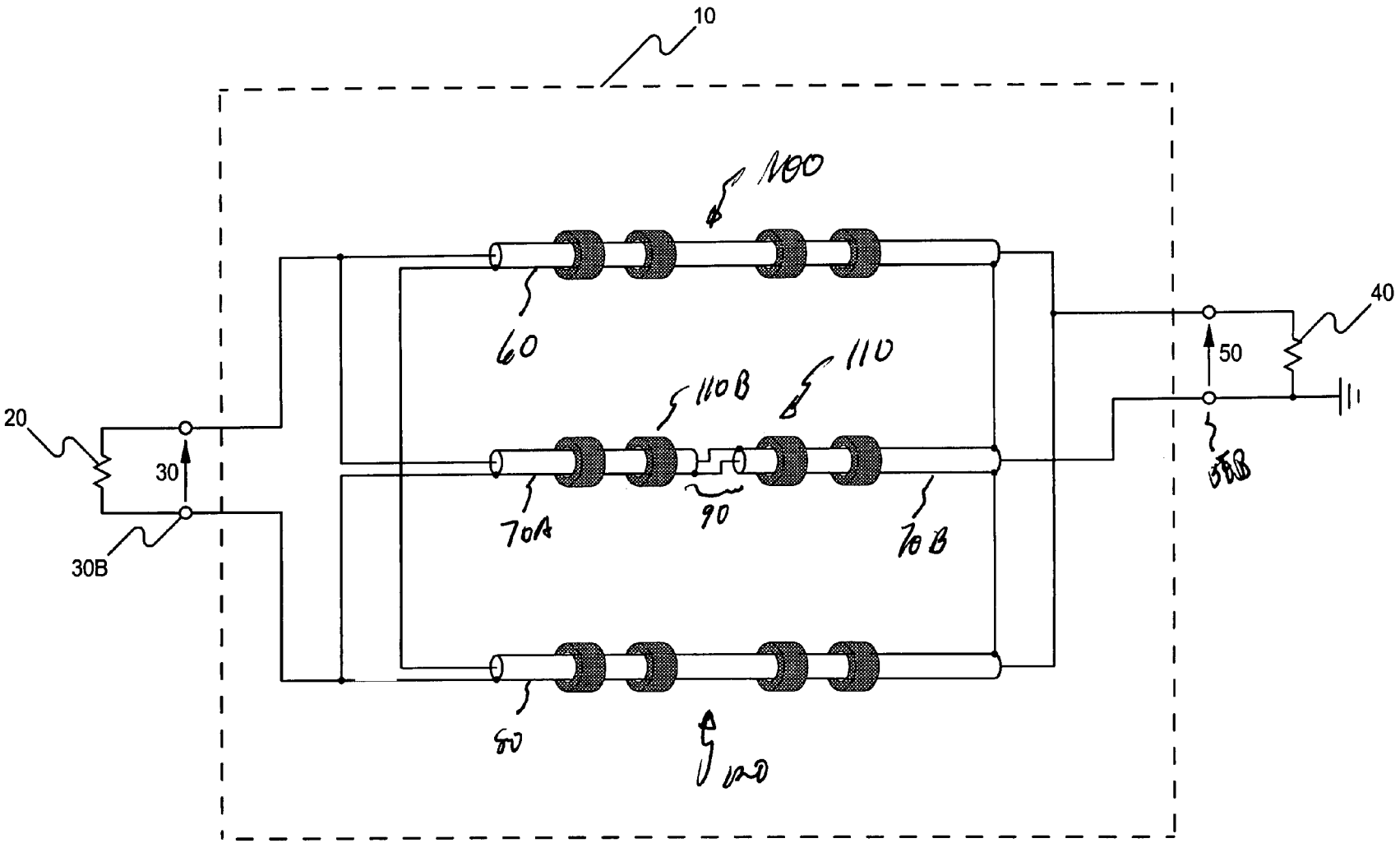
FIG. 3 illustrates an application providing impedance matching between impedance 20 that is floating with respect to ground and impedance 40 that is single-ended to ground where terminal 50B is connected to ground.
Figure 4:
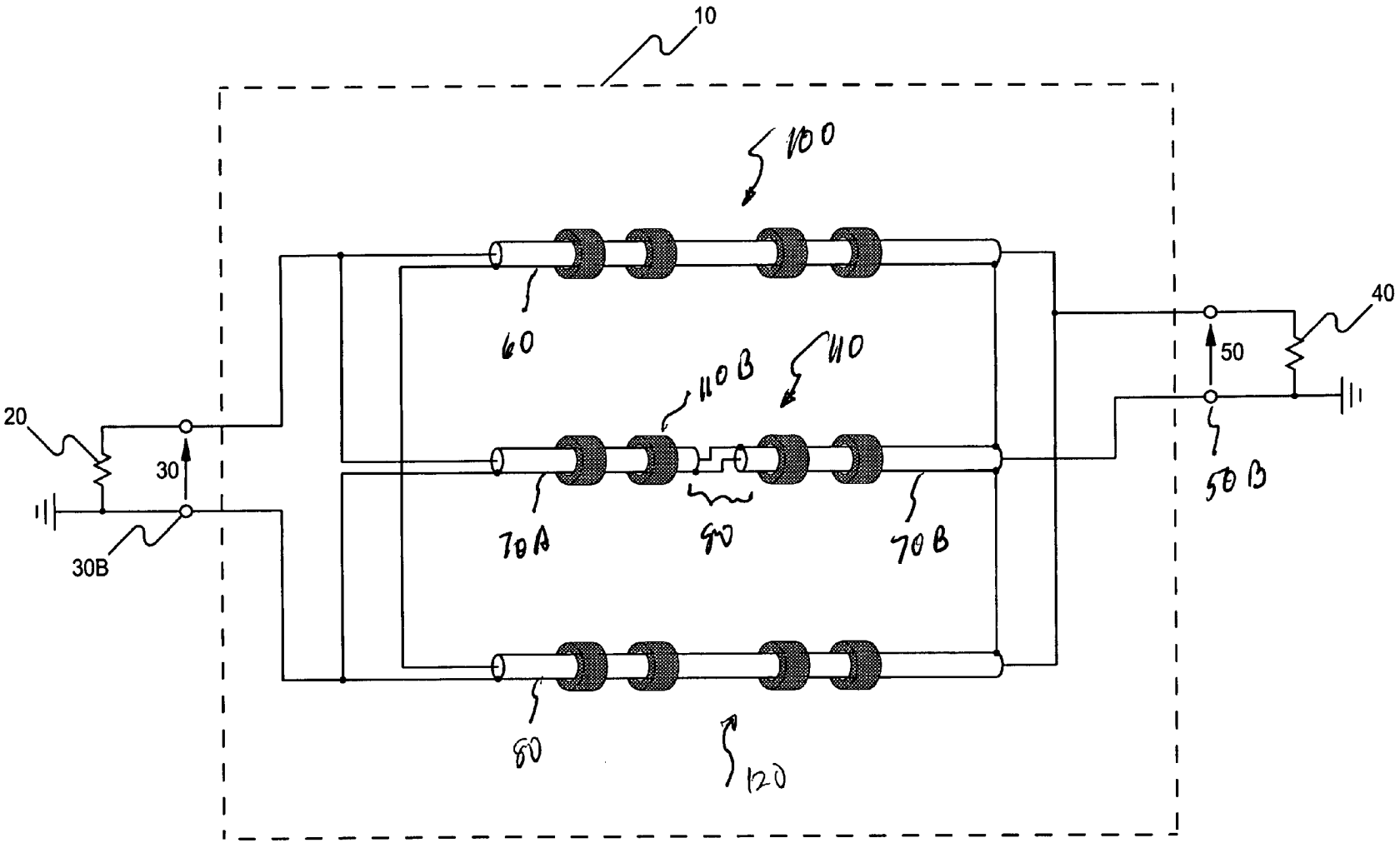
FIG. 4 illustrates an application wherein both impedances 20 and 40 are single-ended to ground wherein terminals 30B and 50B are both connected to ground.

FIG. 3 of the included drawings illustrates an application providing impedance matching between impedance 20 that is floating with respect to ground and impedance 40 that is single-ended to ground where terminal 50B is connected to ground. FIG. 4 of the included drawings illustrates an application wherein both impedances 20, 40 are single-ended to ground wherein terminals 30B, 50B are both connected to ground. The configuration illustrated in FIG. 4 provides both impedance matching between port 30 and port 50 and non-inverting operation. Specifically, a signal at port 30 with respect to ground is transformed in impedance and non-inverted with respect to ground at port 50.

Figure 5:
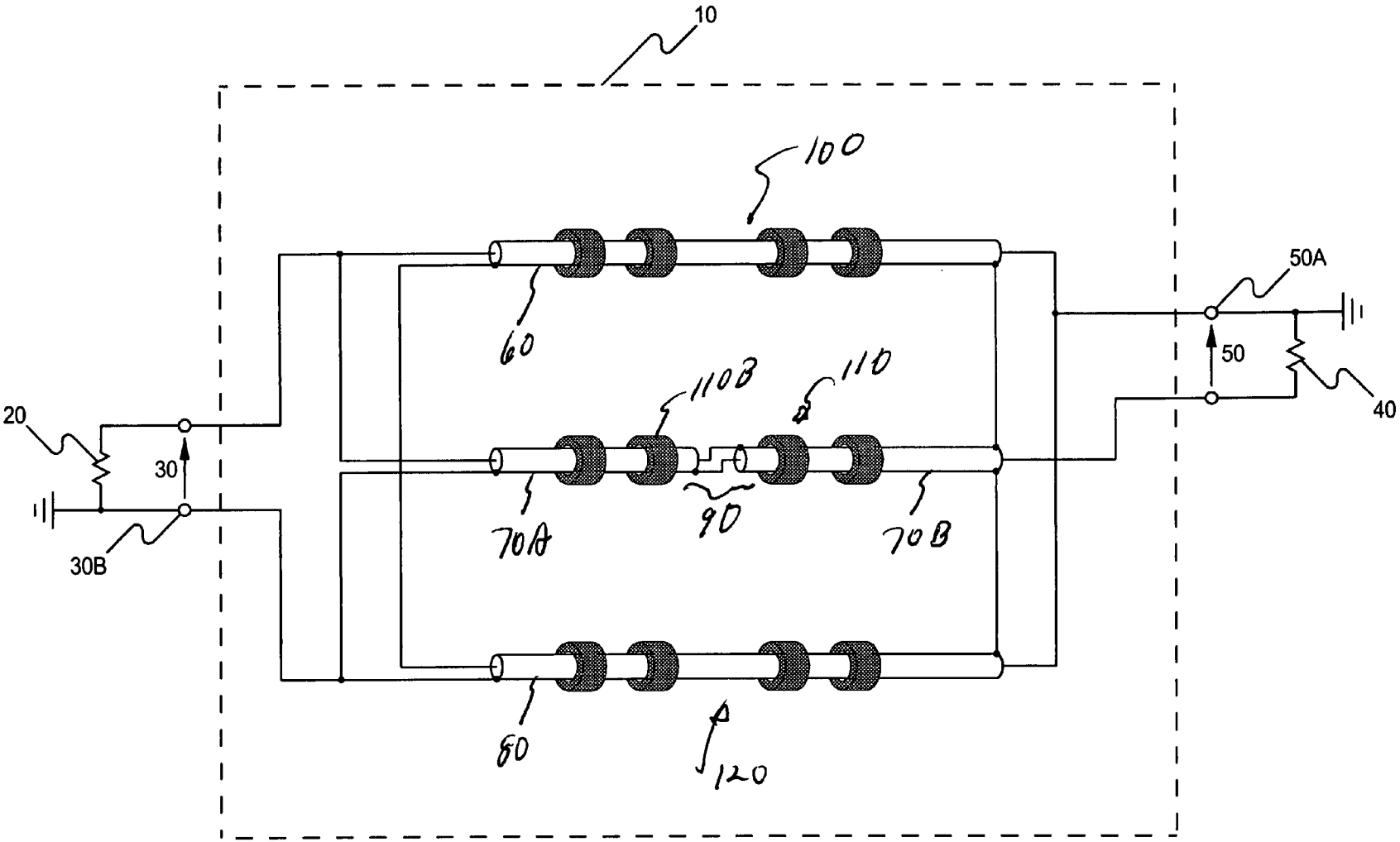
FIG. 5 illustrates an inverting configuration to FIG. 4 wherein terminal 50A is grounded.

Inverting operation may also be provided, according to the present invention. FIG. 5 of the included drawings illustrates an inverting configuration wherein terminal 50A is grounded.

Figure 6:
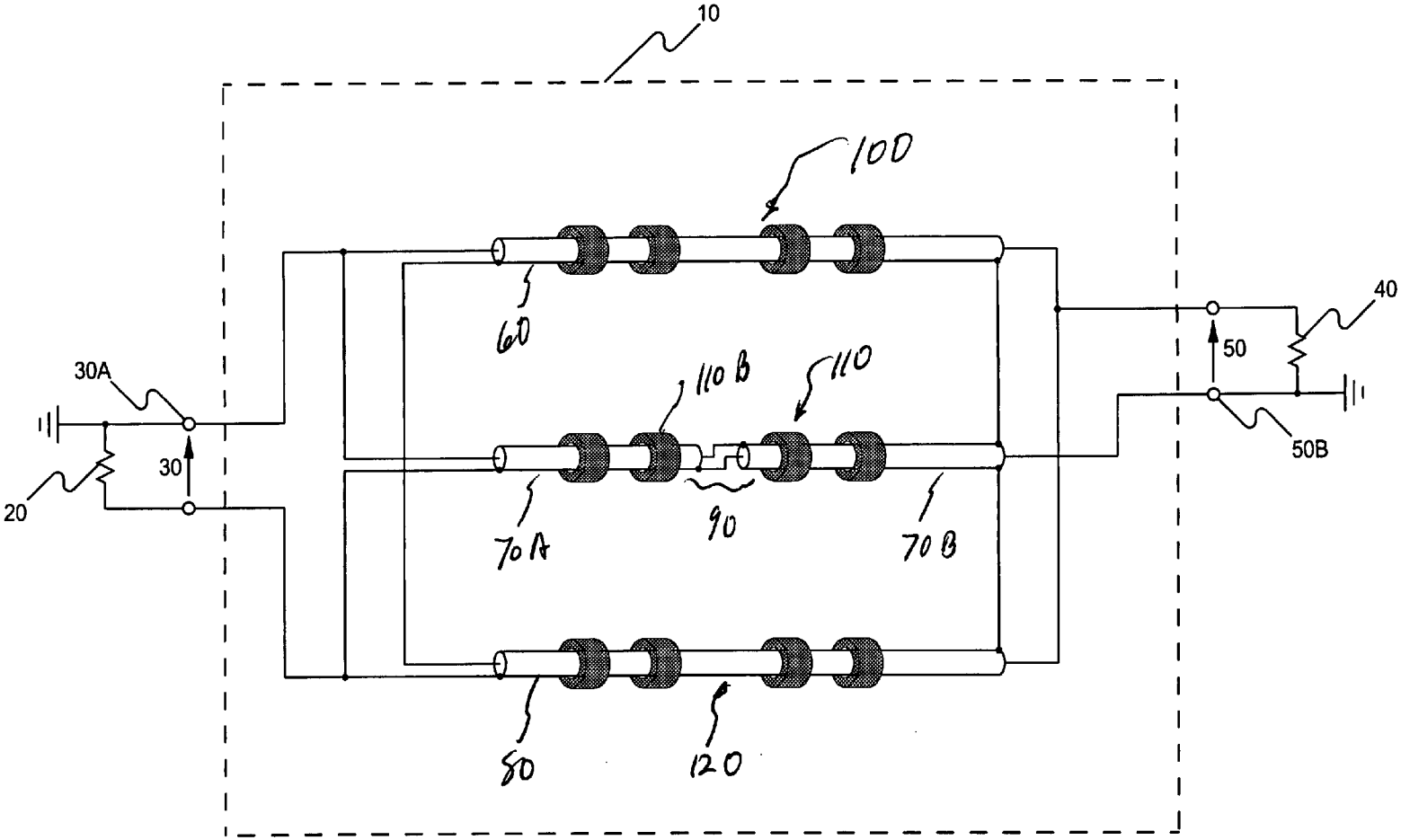
FIG. 6 illustrates an inverting operation wherein terminals 30A and 50B may be grounded.

Similarly, with reference to FIG. 6 of the included drawings, terminals 30A, 50B may be grounded as illustrated to provide inverting operation.

It is intended that "ground" as referenced herein may be any signal reference and is not limited to represent earth ground or any specific circuit ground. Further, whereas the ports according to the present invention, for example with reference to FIG. 1, ports 30 and 50, are isolated from each other by means of the electrical length of the transmission-line sections or means and magnetic means, as described below, the ports may be referenced to different signal references to provide operation required in specific applications.

With reference to FIG. 1, high-frequency isolation is provided between ports 30, 50 by the electrical length of the transmission-line section or means 60, 70A, 70B, 80. Magnetic mechanism or means 100, 110, 120 provide low-frequency isolation between port 30 and port 50, which improves operation to very low frequencies. The magnetic mechanism or means increases the magnetizing inductance of the corresponding conductor to which applied and improves the mutual coupling between the conductors. The magnetic mechanism or means also increases the common-mode inductance, but its primary purpose is to increase magnetizing inductance to extend operation to lower frequencies. For example, a lower −3 dB frequency as low as 10 kHz is easily provided, according to the present invention. Magnetic mechanism or means 100, 110, 120 may be all of the same type material, each of a different type of material, or a combination thereof. The individual magnetic mechanism or means, for example 100A, 100B, 100C 100D, may be all equally spaced or may be unequally spaced. Further, one or more magnetic mechanism or means may be omitted from one or more transmission-line means in configurations according to the present invention to reduce cost or size, where such magnetic means are not necessary to improve performance. For example, magnetic mechanism or means may be omitted from a coaxial transmission-line section or means wherein the shield connections at both ends of the coaxial transmission-line section or means are connected such that the two shield connections are at the same RF potential or where both shield connections are connected to the same ground reference. Further, each magnetic mechanism or means 100, 110, 120 may comprise several individual magnetic means of the same type material, each of a different type of material, or a combination thereof.

Figure 1B:
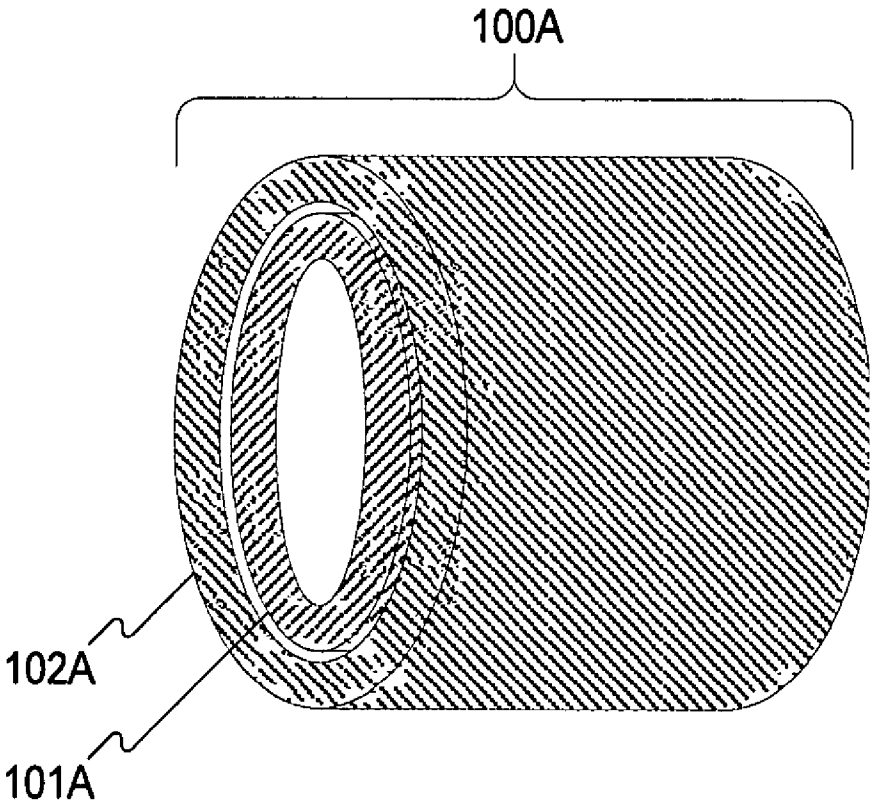
FIG. 1B illustrates a hybrid magnetic means comprising a plurality of individual magnetic means fitted coaxially together providing unique magnetic properties unattainable from a single magnetic means.

Additionally, one or more magnetic mechanism or means according to the present invention may comprise a hybrid construction wherein two or more different magnetic materials are combined to provide the advantages of each individual magnetic material with the combined hybrid means providing performance that cannot be attained in a single magnetic mechanism or means. To explain more fully, with reference to FIG. 1B of the included drawings, a hybrid magnetic mechanism or means 100A according to the present invention may be provided by a first magnetic mechanism or means 101A comprising a comparatively high-frequency, comparatively low permeability magnetic material surrounded by a second magnetic mechanism or means 102A comprising a comparatively low-frequency, comparatively high-permeability magnetic material. At low frequencies, the electromagnetic fields on the line mechanism or means according to the present invention will be influenced by both the high and low permeability magnetic materials according to the hybrid mechanism or means according to the present invention. Such influence by both the low permeability material 101A and the high-permeability material 102A according to the hybrid mechanism or means provides very low-frequency operation according to the present invention. At high frequencies, the electromagnetic fields concentrate primarily in the high-frequency material 101A according to the hybrid mechanism or means and are thereby reduced in the low-frequency material 102A. Whereas the low-frequency material will exhibit comparatively high loss at high operating frequencies, the concentration of the electromagnetic fields primarily in the high-frequency material and the reducing of the electromagnetic fields in the low-frequency material reduces high-frequency loss according to the present invention. Accordingly, the application of hybrid magnetic mechanism or means according to the present invention provides very low-frequency operation while also providing very high-frequency operation. Therefore, application of hybrid magnetic mechanism or means according to the present invention provides improved bandwidth according to the present invention. The use of two magnetic materials 101A and 102A in a hybrid mechanism or means 100A is intended as illustrative only, and more than two magnetic materials may be used in the hybrid magnetic mechanism or means according to the present invention.

Figure 7:
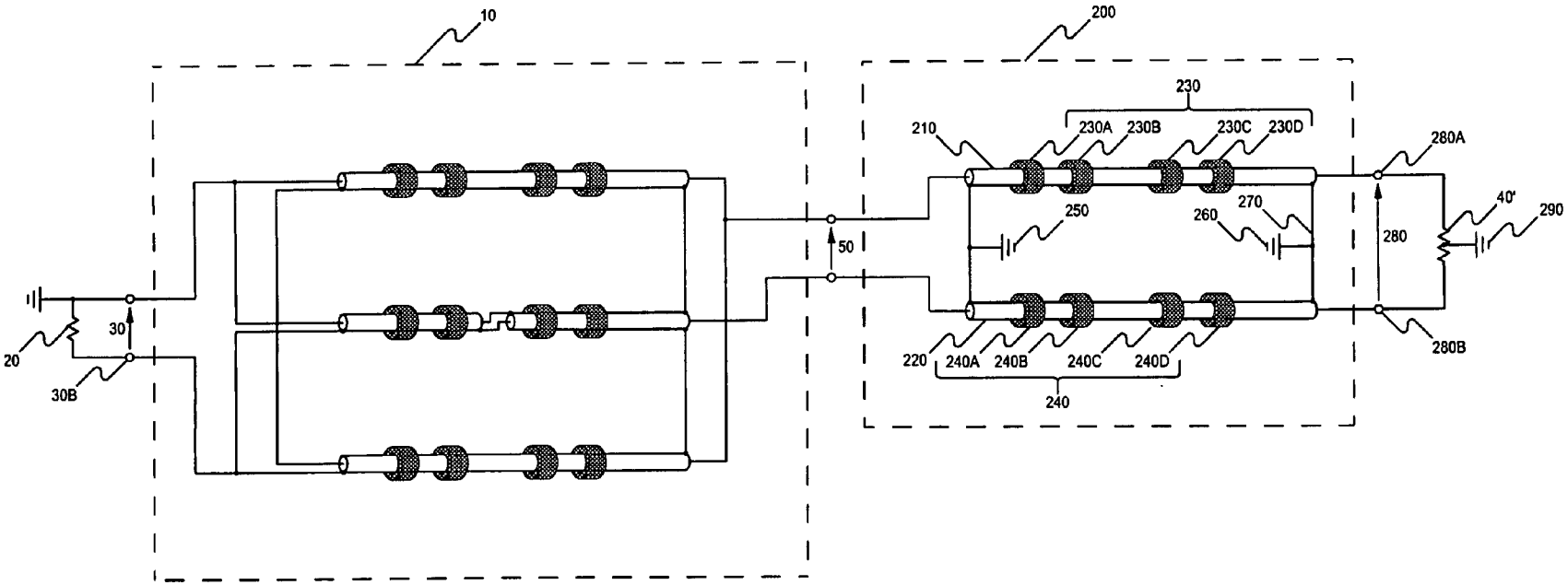
FIG. 7 illustrates an embodiment of the present invention comprising transformation from a single-ended impedance 30 to a balanced impedance 40'.

The present invention may also be configured to provide balanced port impedance. An embodiment of the present invention comprising transformation from a single-ended impedance 30 to a balanced impedance 40' is illustrated in FIG. 7. With reference to FIG. 7, a second transformation mechanism or means 200 is applied in addition to transformation mechanism or means 10 as described above. Transformation mechanism or means 200 provides 1:1 impedance transformation and balanced impedance to ground. Transmission-line sections or means 210, 220 are connected in series at port 50. Accordingly, the impedance presented at port 50 by the series combination of transmission-line sections or means 210, 220 is the sum of the impedances of transmission-line sections or means 210, 220. In normal practice of the present invention, the impedances of transmission-line sections or means 210, 220 would be equal, but may be made different to achieve desired operation needed in specific applications of the present invention. Magnetic mechanism or means 230, 240 are provided to improve low-frequency operation as described above. Ground connection mechanism or means 250 may be provided to present a balanced impedance that is balanced about ground at port 50. Similarly, grounding mechanism or means 260 may be used to provide a balanced impedance at port 280. In applications wherein the impedances of transmission-line sections or means 210 and 220 are equal and grounding means 260 is provided, the present invention provides impedance transformation from port 30 to port 40' and further provides a highly-balanced impedance at port 280 that is very accurately balanced about ground. For example, if impedance 20 is set to 50 ohms, the total nominal impedance 40' is set to 100 ohms, transformation mechanism or means 10 is configured as recited above to provide 1:2 impedance transformation from 50 ohms to 100 ohms, the impedance presented at port 50 by transformation mechanism or means 10 is 100 ohms. If transmission-line sections or means 210, 220 are set equal to each other and equal to 50 ohms, the impedance presented by transformation mechanism or means 200 at port 50 is 100 ohms. Accordingly, the connection of transformation mechanism or means 10 and 200 at port 50 is therefore matched in impedance. Transmission-line sections or means 210, 220 are also connected in series at port 280 by connections or connection means 270. Accordingly, the impedance presented at port 280 by the series combination of transmission-line sections or means 210, 220 is the sum of the impedances of transmission-line sections or means 210, 220. Accordingly, for transmission-line sections or means 210, 220 both equal to 50 ohms, the impedance presented at port 280 is 100 ohms. The embodiment of the present invention illustrated in FIG. 7 therefore provides transformation from 50-ohm impedance 20 to balanced impedance 40'.

The configuration illustrated in FIG. 7 can be configured to accommodate various configurations of impedances. For example, grounding mechanism or means 260 may be provided or deleted to provide specific operation required in applications of the present invention. For example, if grounding mechanism or means 290 is absent, impedance 40' will be floating with respect to ground. Providing grounding mechanism or means 260 and connections 270 with a floating impedance 40' will precisely balance floating impedance 40' about ground. If grounding mechanism or means 290 is present in impedance 40', grounding mechanism or means 260 may be deleted to allow the port 280 to be floating with respect to ground. With grounding mechanism or means 260 deleted and grounding mechanism or means 290 present in impedance 40', the balance of impedance 40' about ground is unaffected by connection to port 280 of the present invention. Accordingly, the balance of impedance 40' with respect to ground is preserved. For example, if an impedance 40' were required to be asymmetric with respect to ground in a specific application of the present invention, deleting grounding mechanism or means 260 would provide accurate impedance matching to impedance 40' while preserving the required impedance asymmetry. Further, if grounding mechanism or means 290 were absent and it was desired to preserve the floating nature of impedance 40', deleting grounding means 260 would preserve the floating character of impedance 40'. An example would be if impedance 40' is a nominal 100-ohm unshielded twisted pair ("UTP") where it is desired to preserve the floating nature of the UTP pair.

Figure 8:
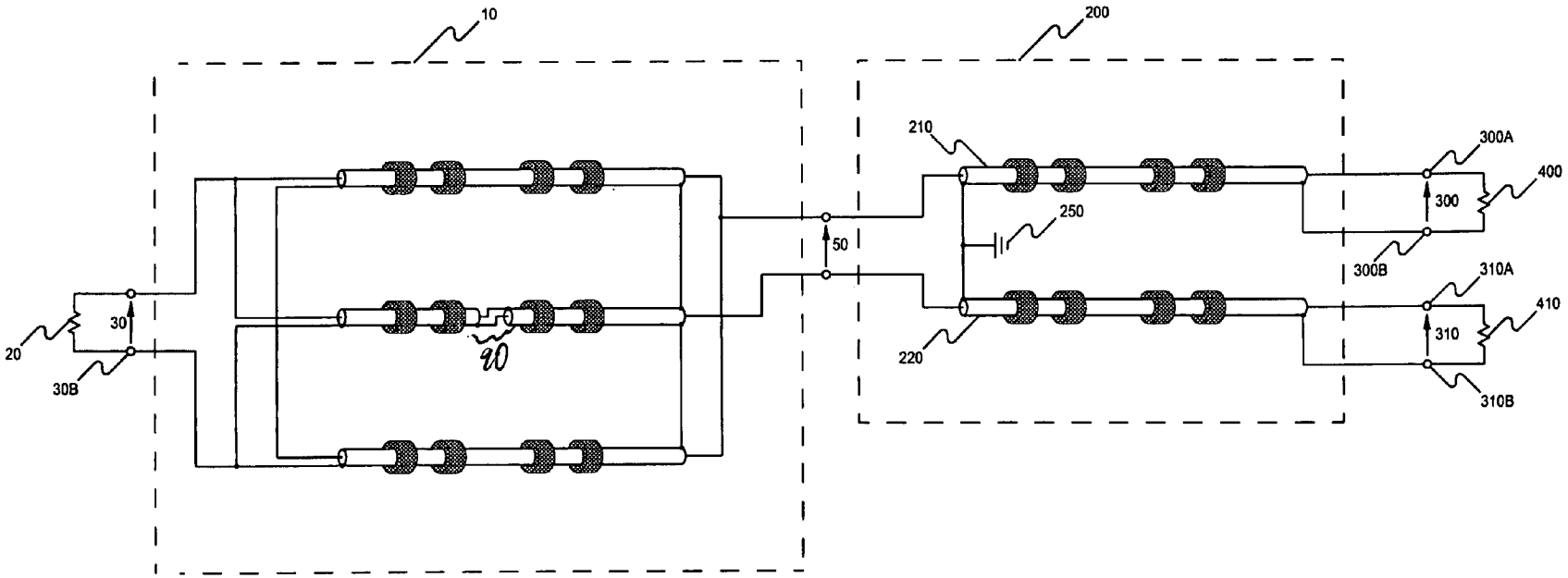
FIG. 8 illustrates an example of a three-port configuration.

The present invention may also be configured to provide more than two signal ports. FIG. 8 illustrates an example of a three-port configuration. The present invention illustrated in FIG. 8 provides precise, low-loss, wide-bandwidth power division from port 30 to ports 300, 310 or precise, low-loss, wide-bandwidth power combining from ports 300, 310 to port 30. With reference to FIG. 8, ports 300 and 310 are totally floating ports, floating with respect to ground and isolated from each other. Impedance matching is provided where the impedance of transmission-line section or means 210 matches an impedance 400 connected to it, and the impedance of transmission-line section or means 220 matches an impedance 410 connected to it. Whereas ports 300, 310 are totally floating, either terminal of these ports may be grounded to provide specific performance that may be required in applications of the present invention. For example, if a signal is input at port 30 and if terminals 300B, 310A located at ports 300, 310 of FIG. 8 are both grounded where the impedances 400, 410 are equal, the signal appearing at terminals 300A, 310B will be equal in magnitude and phase and in phase with the source at port 30. Therefore, such an application of the present invention provides precision non-inverting power division from port 30 to ports 300 and 310. If instead, terminals 300A, 310B are grounded, the signals appearing at terminals 300B, 310A will again be equal in magnitude and phase, but will be phase opposed to the source signal at port 30. Therefore, such an application of the present invention provides precision inverting power division from port 30 to ports 300, 310. Additionally, terminals 300B, 310B may be grounded or terminals 300A, 310A may be grounded to provide signals at ports 300 and 310 that are equal in magnitude and phase opposed. Similarly, signals may be input at ports 300, 310 wherein such signals appear added at port 30. Therefore, such application, according to the present invention, provides precision, low-loss, wide-bandwidth signal splitting and combining. The circuit of FIG. 8 is a precision, low-loss, wide-bandwidth power divider and additionally provides the means to deliver common-mode drive to a load, for example common-mode drive of a UTP pair.

Figure 9:
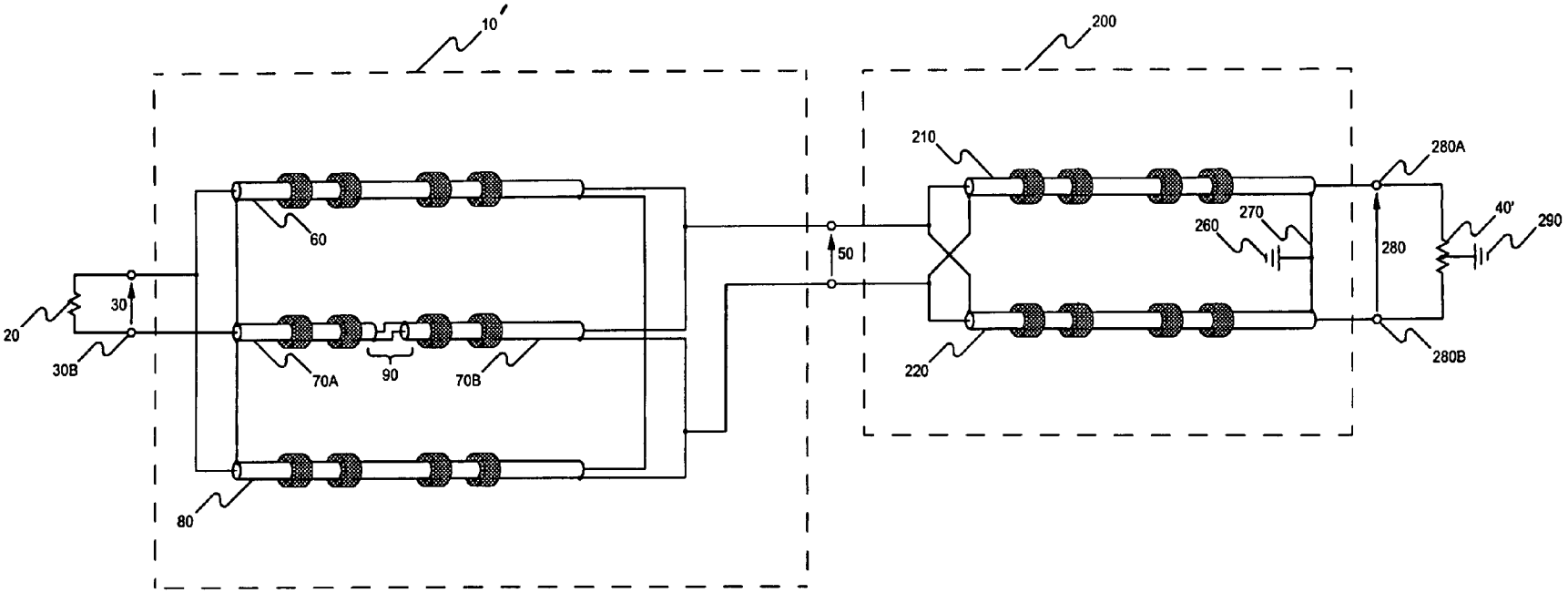
FIG. 9 illustrates an embodiment of the present invention wherein a nominal 2:1 impedance transformation is provided from port 30 to port 50 by transformation means 10', and a 1:4 impedance transformation is provided from port 50 to port 280 by transformation means 200.

The present invention is not limited to the low-to-high transformation as recited hereinabove. FIG. 9 illustrates an embodiment of the present invention wherein a 2:1 impedance transformation is provided from port 30 to port 50 by transformation mechanism or means 10, and a 1:4 impedance transformation is provided from port 50 to port 280 by transformation mechanism or means 200. As recited above, Mobius-Gap 90 provides high-performance means of signal inversion providing optimizing of physical constructions. For example, if impedance 20 is 50 ohms, transmission-line sections or means 60, 70A, 70B, 80 are 35.4 ohms, and transmission-line sections or means 210, 220 are 50 ohms, the 50-ohm impedance at port 30 is first transformed to 25 ohms at port 50 and then to 100 ohms at port 280. Accordingly, the configuration as illustrated in FIG. 9 provides impedance transformation from the 50-ohm impedance at port 30 to a 100-ohm impedance at port 280. Further, as recited hereinabove, if impedance 40' includes grounding mechanism or means 290, grounding means 260 may be deleted to provide port 280 floating such that the balance of impedance 40' is unaffected by connection to port 280. Similarly, if grounding mechanism or means 290 is absent in impedance 40', grounding mechanism or means 260 may be provided to provide a precisely balanced connection to impedance 40'. And if grounding mechanism or means 290 is absent, grounding mechanism or means 260 may be deleted to provide floating connection to floating impedance 40', a floating UTP pair for example.

Figure 10:
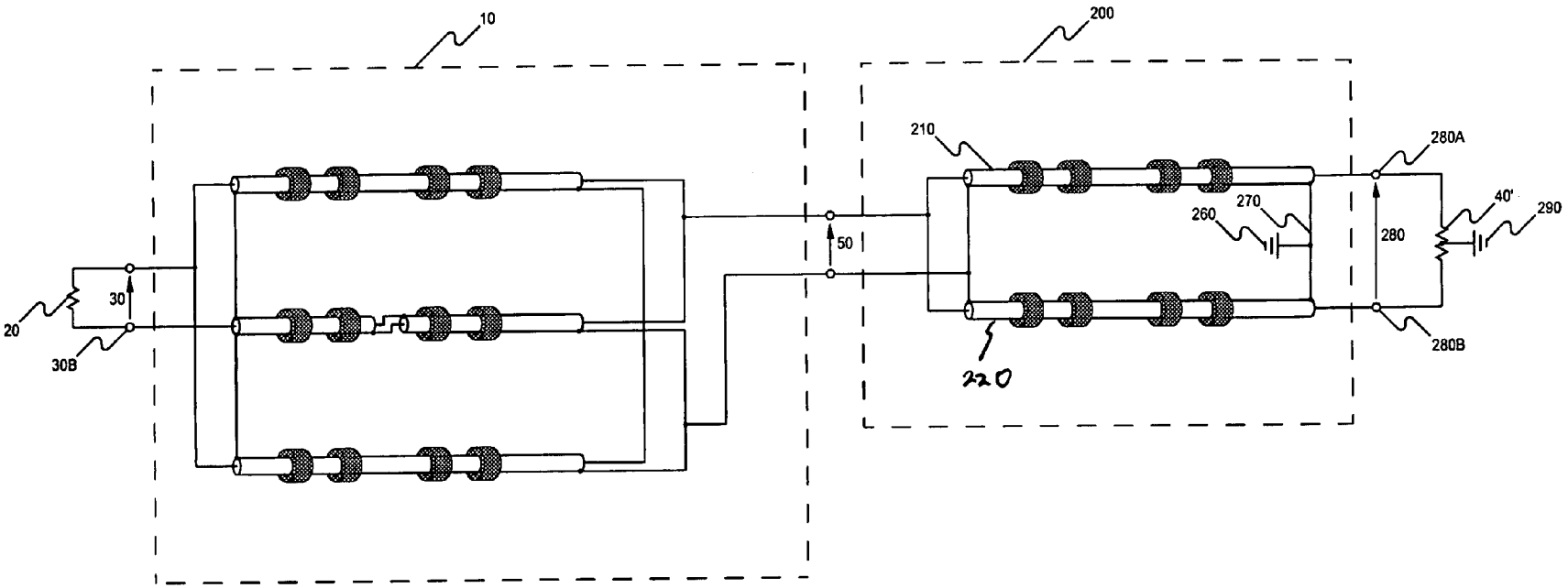
FIG. 10 illustrates a configuration wherein the two transmission-line means 210 and 220 are connected in simple parallel.

FIG. 10 illustrates a configuration wherein the two transmission-line means 210, 220 are connected in simple parallel. A signal input at port 30 will be divided equally between two terminals 280A, 280B of port 280 such that the signals at terminals 280A, 280B will be equal in both magnitude and phase and in phase with the source at port 30. Accordingly, the configuration of the present invention illustrated in FIG. 10 provides precise common-mode connection to the impedance 40'. For example, if impedance 40' is a UTP pair and the present invention as illustrated in FIG. 10 is applied to deliver a signal from a source at port 30 to the UTP pair at port 280, the present invention will deliver a very precise, wide-bandwidth, low-loss common-mode excitation to the UTP pair.

Figure 11:
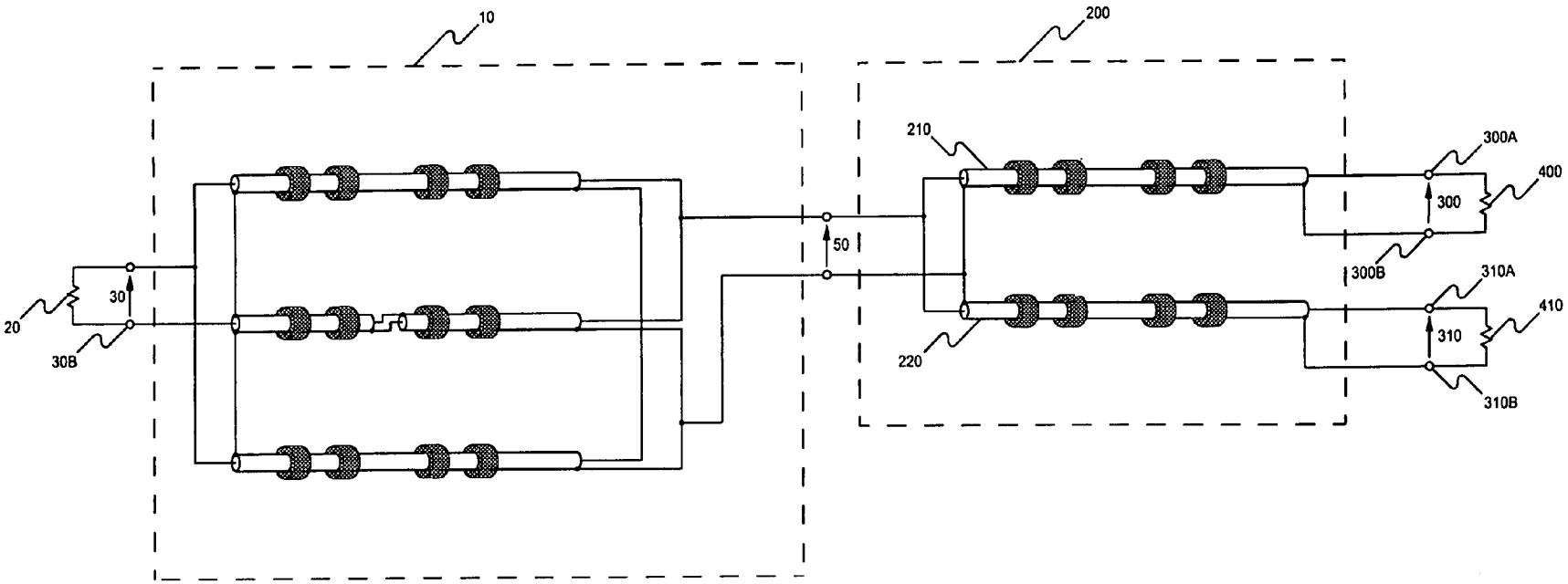
FIG. 11 illustrates a configuration providing precise, low-loss, wide-bandwidth power division.

FIG. 11 of the included drawings illustrates a configuration providing precise, low-loss, wide-bandwidth power division. For two, equal impedances 400, 410 for example 50 ohms, a signal input at port 30 is divided precisely between impedances 400, 410. As recited hereinabove, grounding mechanism or means may be applied to the terminals of ports 300, 310 to provide signals at ports 300, 310 that are equal in magnitude and in phase with each other and in phase with the source at port 30, in phase with each other and phase opposed to the source at port 30, or phase opposed to each other.

The present invention is versatile and is tolerant of variations in parameter values and materials and therefore allows the use of common materials while still providing the high performance. For example, 35-ohm transmission-line materials are common in the art. With reference to FIG. 9, if 35-ohm transmission-line means are utilized for transmission-line sections or means 60, 70A, 70B, 80 rather than the more ideal 35.4-ohm material recited, the VSWR at port 30 will be improved to 1.05:1 and the VSWR at port 50 will be 1.08:1. Accordingly, excellent performance is also provided using the more standard 35-ohm material rather than the more ideal 35.4-ohm material. Also, with reference to FIG. 7, where the impedance of load 40' is similar to the impedance of a UTP pair and in applications where maximum bandwidth is not needed, transmission-line sections or means 210 and 220 may be replaced with a section of UTP pair, for example to reduce cost or simplify construction.

Figure 12:
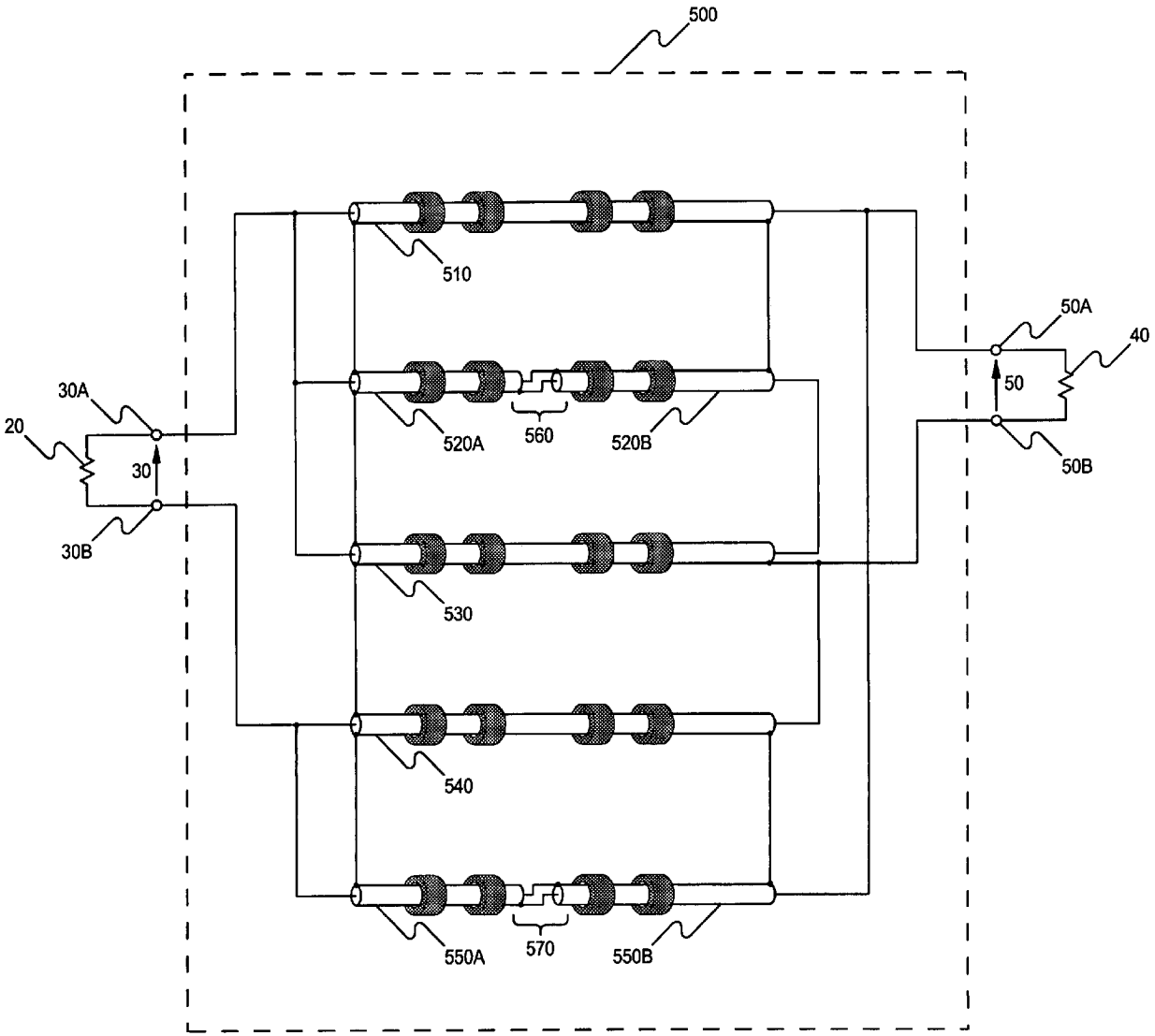
FIG. 12 illustrates an embodiment 500 comprising five transmission-line means providing an impedance transformation of 1:1.44.

The present invention is not limited to only three transmission-line means as illustrated in transformation mechanism or means 10 in FIG. 1, but may be applied using a plurality of transmission-line means. FIG. 12 of the included drawings illustrates another embodiment according to the present invention. Mechanism or means 500 comprises five transmission-line sections or means providing an impedance transformation of 1:1.44. One application of such a configuration may be applied to provide impedance matching between 50 and 75 ohms. For example, with reference to FIG. 12, if the impedances of all transmission-line sections or means 510, 520A, 520B, 530, 540, 550A, 550B are all made 61.2 ohms, the impedance presented at port 30 is 51 ohms, providing a VSWR at port 30 of 1.02:1, and the impedance at port 40 is 73.6 ohms, also providing a VSWR at port 40 of 1.02:1. Mobius-Gaps 560 and 570 are applied to provide optimum physical construction required for wide-bandwidth, low-loss operation as recited hereinabove. Specifically, application of Mobius-Gaps 560 and 570 provides all the shields of all five transmission-line means at port 30 to be connected directly together with direct connection of the center conductors, as shown, while also providing direct connection of shields and center conductors at port 50, as shown. This configuration requires only a single center-conductor to shield cross connection.

The magnetic mechanism or means shown in FIG. 1 may comprise multiple individual magnetic mechanism or means, 100A through 100D for example, to achieve operation required in specific applications. The number of magnetic mechanism or means, the magnetic properties of each individual magnetic mechanism or means, and the physical construction of each magnetic mechanism or means are for illustrative purposes only and any number of magnetic mechanism or means of any magnetic properties with any physical construction may be applied to achieve desired operation in specific applications of the present invention. For example, either single aperture or multiple-aperture magnetic mechanism or means may be applied for one or more of the individual magnetic mechanism or means, and all of the several individual magnetic mechanisms or means may be all of the same material and construction, each of a different material or construction, or of a combination of similar and different materials and constructions. More specifically, with reference to FIG. 1, one or more of the individual magnetic mechanisms or means 100A through 100D may be selected of a high-permeability magnetic material, a ferrite or metallic material for example, to maximize the magnetizing inductance of the transmission-line sections or means 60 about which these magnetic mechanisms or means are assembled to provide very low-frequency operation. Additionally, one or more of the individual magnetic mechanisms or means 100A through 100D may be selected of a high-frequency, low-loss magnetic material, a low-loss powdered-iron material for example, to minimize the leakage reactance in the transmission-line sections or means 60 at very high frequencies to provide low-loss, high-performance operation at very high frequencies. Accordingly, such combination of various magnetic means, according to the present invention, provides low-loss operation over very wide-bandwidth.

Figure 13:
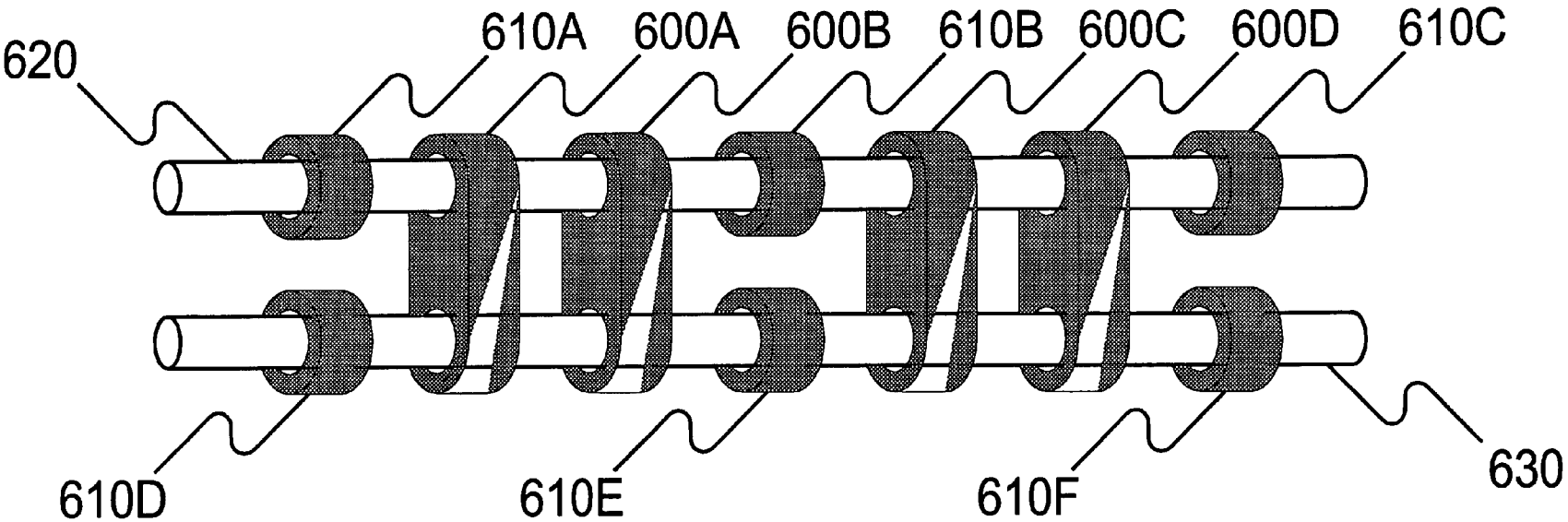
FIG. 13 illustrates the application of a combination of dual aperture magnetic means 600 comprising individual magnetic means 600A through 600D and single-aperture magnetic means 610 comprising individual magnetic means 610A through 610F assembled on a pair of transmission-line means 620 and 630.

Various physical shapes of the magnetic means may be applied to provide performance needed in specific applications or to reduce size or cost. FIG. 13 illustrates the application of a combination of dual aperture magnetic mechanisms or means 600 comprising individual magnetic mechanisms or means 600A through 600D and single-aperture magnetic mechanisms or means 610 comprising individual magnetic means 610A through 610F assembled on a pair of transmission-line means 620, 630. It is intended that FIG. 13 is understood to be illustrative only of an embodiment comprising two transmission-line sections or means. Accordingly, transmission-line sections or means 620, 630 may comprise any two of the transmission-line sections or means. For example, line section or means 60, 80 with reference to FIG. 1 may be configured together with single and dual-aperture magnetic means as illustrated in FIG. 13. Similarly, line sections or means 210, 220 with respect to FIG. 7, may be configured together with single and dual-aperture mechanisms or magnetic means as illustrated in FIG. 13. As illustrated in FIG. 13, single-aperture mechanisms or means, 610A through 610F for example, may also be provided in addition to dual-aperture mechanisms or means, 600A through 600D for example, to provide performance needed in specific applications. For example, a high-permeability dual-aperture magnetic mechanisms or means 600A through 600D may be applied to provide operation to very low frequency and to minimize size and cost. Additionally, high-frequency, low loss single aperture magnetic mechanisms or means 610A through 610F may be applied to provide operation to very high-frequency. As referenced hereinabove, the magnetic material of the several magnetic mechanisms or means may all be of the same material type, each of a different material type, or a combination thereof. Also, the physical assembly of FIG. 13 is intended as illustrative only, and the several magnetic means may be assembled in any order and any number of magnetic means may be applied.

Figure 14:
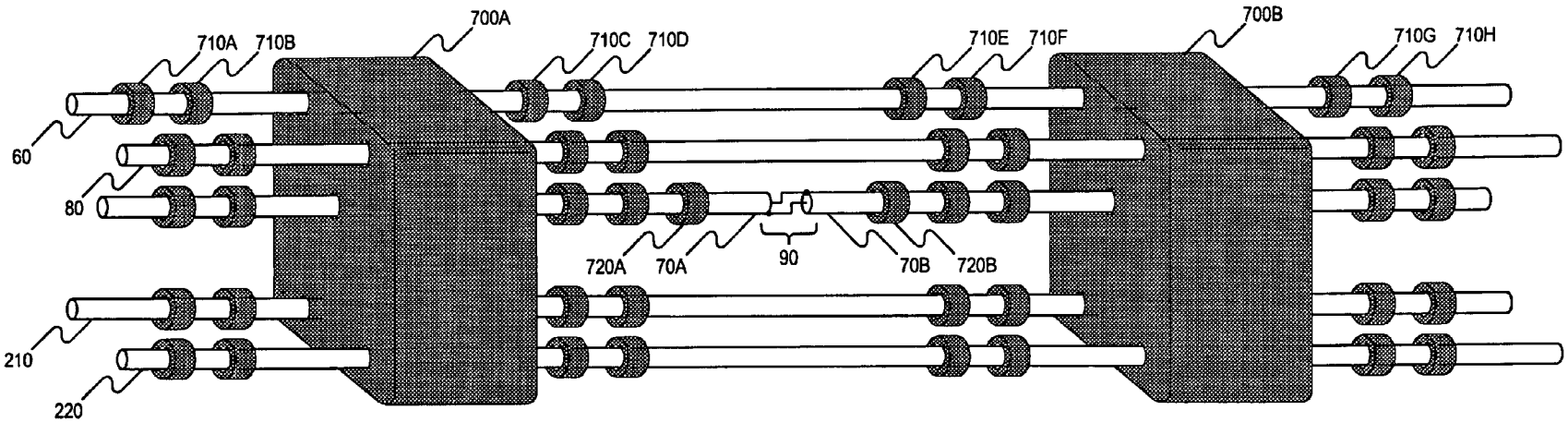
FIG. 14 illustrates a combination of several five-aperture magnetic means 700A and 700B in combination with individual single aperture magnetic means, for example 710A through 710H, to accommodate five transmission-line means.

Any physical configuration of magnetic means may be applied to achieve the objects of the present invention. For example, custom magnetic means may be constructed comprising multiple apertures accommodating some or all the transmission-line means. For example, FIG. 14 illustrates a combination of several five-aperture magnetic mechanisms or means 700A, 700B in combination with individual single aperture magnetic means, for example 710A through 710H, to accommodate five transmission-line sections or means. For example, the transmission-line sections or means 60, 70A, 70B, 80, 210, 220 with reference to FIG. 9 may be accommodated as illustrated in FIG. 14. Additionally, magnetic mechanisms or means 720A, 720B as illustrated in FIG. 14 on either side of the Mobius-Gap means 90 may be additionally utilized to precisely control the leakage reactance at the Mobius-Gap means 90 to optimize high-frequency performance. As referenced hereinabove, the magnetic material types of the several magnetic means may be all of the same material type, each of a different material type or a combination thereof.

Figure 15:
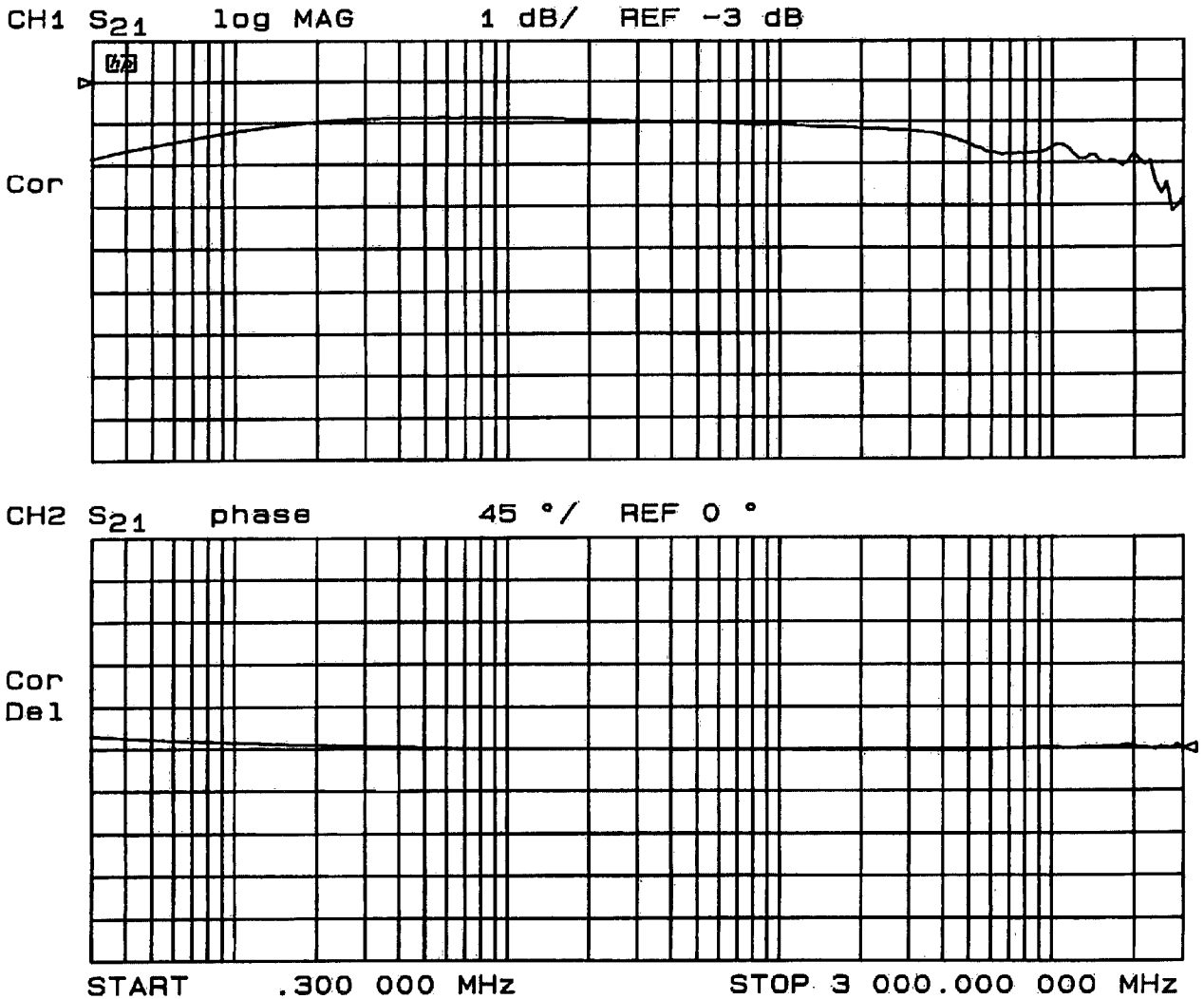
FIG. 15 illustrates the frequency response of a physical embodiment of the present invention substantially equivalent to the embodiment illustrated in FIG. 7 configured for matching from a 50-ohm single-ended source at port 30 to a 100-ohm balanced load at port 280 over the frequency range of 300 kHz to 3 GHz.

FIG. 15 of the included drawings shows the frequency response of a physical embodiment of the present invention substantially equivalent to the embodiment illustrated in FIG. 7 configured for matching from a 50-ohm single-ended source at port 30 to a 100-ohm balanced load at port 280 over the frequency range of 300 kHz to 3 GHz. The test equipment available limited the measurement range illustrated. In this configuration, connection mechanisms or means 270, ground mechanisms or means 260, and ground mechanisms or means 250 with reference to FIG. 7 are provided. The data presented in FIG. 15 is the ratio expressed in dB of the single-ended signal at port 280A to the signal at port 30. Accordingly, this is one-half of the total balanced signal delivered to impedance 40'. If the impedance matching were ideal and the structure lossless, the signal at port 280A would be in phase with and 3 dB below the signal at port 30. The data of FIG. 15 shows that the mid-band signal at port 280A is in phase with and nominally 4 dB below the signal at port 30, and that the response is down nominally 1 dB from its mid-band level at 300 kHz, and down nominally 2 dB at 3 GHz. Accordingly, the response of the embodiment of the present invention characterized in FIG. 15 exhibits a −3 dB bandwidth in excess of 300 kHz to 3 GHz and an excess loss of nominally 1 dB. The lower and upper −3 dB frequencies were measured independently and found to be nominally 10 kHz and 10 GHz respectively providing a total bandwidth of nominally 20 octaves.

Figure 16:
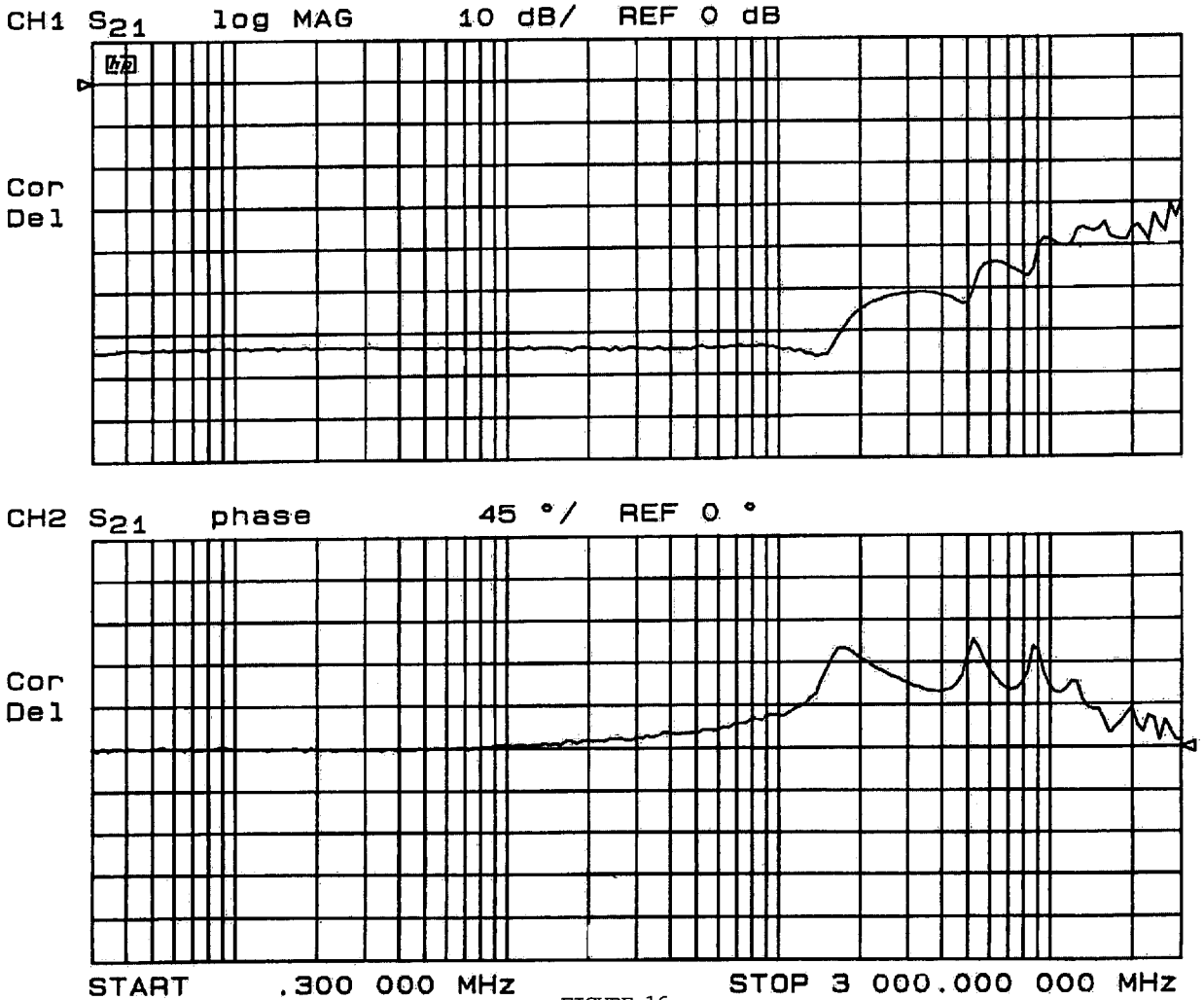
FIG. 16 illustrates the ratio of the common mode signal to the signal at port 30 of the same physical embodiment referenced hereinabove characterized in FIG. 15.

With reference to FIG. 7, if the signal balance at port 280 were ideal, the two signals at ports 280A and 280B would be identical in magnitude and phase opposed by 180 degrees. The common-mode signal component would then be zero, and ratio of the common-mode signal to the balanced signal would be zero. FIG. 16 of the included drawings shows the ratio of the common mode signal to the signal at port 30 of the same physical embodiment referenced hereinabove characterized in FIG. 15. The actual reference level for the measurement system applied to collect the response of FIG. 16 is −3 dB with respect to the common-mode signal due to the design of the test fixture, however the instrument utilized for the measurement did not provide for this reference level to be input into the reference display field. The true response referenced to a 0 dB reference is 3 dB lower than that displayed in FIG. 16. The common-mode rejection ratio, CMRR, is the reciprocal of the response illustrated in FIG. 16 plus 3 dB. For example, the response illustrated in FIG. 16 shows that the common-mode signal at 10 MHz is about −63 dB with respect to the signal at port 30. Therefore, the true common-mode signal level at 10 MHz is then nominally −66 dB, and the CMRR at 10 MHz of the embodiment of the present invention characterized in FIG. 7 is nominally 66 dB. FIG. 16 further illustrates that the CMRR is greater than nominally 53 dB up to about 500 MHz and then decreases to nominally 33 dB at 3 GHz.

The impedances recited herein are illustrative only, and a very wide range of impedances may be matched. The versatility, according to the present invention, of providing matching between arbitrary impedances and providing wide-bandwidth, low-loss operation is novel over the prior art.

In order to achieve very high-frequency operation and very wide-bandwidth operation in an impedance-transformation means according to the present invention, for example operation above 1 GHz and useful bandwidths as high as 10 kHz to 10 GHz, high-performance coaxial transmission-line means may be utilized as the means for communicating the RF signals. However, the present invention is not limited to coaxial transmission-line sections or means, and any transmission-line sections or means may be applied. For example, coaxial transmission-line sections or means 70A, 70B with reference to FIG. 1 may be implemented comprising a twisted-pair to be utilized for one or more of the transmission-line sections or means to provide desired operation in specific applications of the present invention, for example, to reduce cost or simplify construction in applications of the present invention where extremely high-frequency operation according to the present invention is not required. Similarly, with reference to FIG. 7, transmission-line sections or means 210, 220 may be implemented comprising two parallel-plate transmission-line sections or means or a single parallel-plate transmission-line sections or means with grounding mechanisms or means 250, 260 deleted. Additionally, other transmission-line means, such as stripline or microstrip, may be applied as any of the transmission-line means. Similarly, where such planar transmission-line means are applied, planar magnetic means may also be applied according to the present invention. For example, where a stripline or microstrip transmission-line or means is applied, slabs of magnetic structures or means may be placed on such planar transmission-line constructions to provide similar operation as the magnetic structures or means applied to coaxial transmission-line or means described hereinabove.

Various modifications and changes may be made to the present invention to achieve specific performance needed in applications that will become apparent by practice of the present invention. For example, combinations of coaxial, planar, and twisted-pair transmission-line sections or means may be applied to simplify construction and reduce cost in specific applications where such constructions are capable of providing the performance required. Further, the present invention is not limited to two signal ports and may be configured to provide additional single-ended and balanced ports. For example, if grounding mechanism or means 260 and 270 with reference to FIG. 9 are provided, connectors or means 280A and 280B may be utilized as independent single-ended signal ports where the two ports exhibit 180-degree opposed phase.

It will be apparent to those skilled in the art that modifications and variations may be made to the Wide-Bandwidth Balanced Transformer device. The invention in its broader aspects is therefore not limited to the specific details, representative methods and apparatus, and illustrative examples illustrated and described hereinabove. Therefore, it is intended that all manner contained in the foregoing description or illustrated in the accompanying drawings shall be interpreted as illustrative and not in a limiting sense, and the invention is intended to encompass all such modifications and variations as fall within the scope of the appended claims.

I claim:

1. A wide-bandwidth transformer providing a wide-bandwidth transformation mechanism between impedances comprising:

1. a plurality of transmission-line sections;

2. a plurality of signal ports; and 3. at least one Mobius Gap device, wherein said transmission-line sections are interconnected to provide impedance transformation from at least an impedance at a first port to an impedance at a second port, and said Mobius Gap device provides means to allow said transmission lines to be connected together in a manner to optimize high-frequency, wide-bandwidth connection of said transmission-line sections; and wherein there is further included low frequency isolation mechanisms, said low frequency isolation mechanism including magnetic devices surrounding said transmission-line segments to increase magnetizing inductance.

2. The transformer of claim 1, wherein said impedance transformation mechanism includes a plurality of interconnected transmission-line sections and a plurality of magnetic devices mounted on said sections, said magnetic devices being of different materials.

3. The transformer of claim 1, wherein said impedance transformation mechanism includes a plurality of interconnected transmission-line sections and a plurality of magnetic devices mounted on said sections, said magnetic devices being of same materials.

4. The transformer of claim 1, wherein said impedance-transformation device includes a plurality of interconnected transmission-line sections and a plurality of magnetic devices mounted on said sections, said magnetic devices having the same spacing on corresponding ones of said transmission-line sections.

5. The transformer of claim 1, wherein said impedance-transformation device includes a plurality of interconnected transmission-line sections and a plurality of magnetic devices mounted on said sections, said magnetic devices having different spacing on corresponding ones of said transmission-line sections.

6. The transformer of claim 1, wherein said transformation mechanism includes a plurality of interconnected transmission-line sections and a plurality of magnetic devices mounted on said sections, some of said magnetic devices having the same spacing and some of said magnetic devices having different spacing on corresponding ones of said transmission-line sections.

7. The transformer of claim 1, wherein said impedance transformation mechanism includes a plurality of interconnected transmission-line sections and a plurality of magnetic devices mounted on said sections, said magnetic devices being of some of the same materials and some of different materials.

8. The transformer of claim 7, wherein some of said materials are of low permeability and some of said materials are of high permeability.

9. The transformer of claim 1, wherein said transformation mechanism includes a plurality of interconnected transmission-line sections and a plurality of magnetic devices mounted on said sections, wherein some of said magnetic devices include at least one aperture surrounding at least one transmission-line section.

10. The transformer of claim 9, wherein there is at least one single aperture device.

11. A transformer being at least a first impedance at a first port and a second impedance at a second port, comprising:

a. at least one impedance-transformation device;

b. at least one impedance-balancing device;

wherein said impedance-transformation device includes a plurality of interconnected transmission-line sections and a plurality of magnetic devices mounted on said sections;

said sections connecting the impedances; and wherein at least one of said sections having a Mobius-Gap portion to connect said sections.

12. The transformer of claim 11 wherein said impedances are floating with respect to ground.

13. The transformer as recited in claim 11 wherein said first impedance is single-ended with respect to ground and the second impedance is floating with respect to ground.

14. The transformer as recited in claim 11, wherein said impedance-transformation device is bidirectional between said two impedances.

15. The transformer as recited in claim 11 wherein both said first and said second impedance is single-ended with respect to ground.

16. The transformer as recited in claim 15 wherein said first and second impedances are single-ended with respect to ground at mirror image connections.

17. The transformer as recited in claim 15 wherein said first and second impedances are single-ended with respect to ground at the same side.

* * * * *